US007604312B2

(12) United States Patent
Wade

(10) Patent No.: US 7,604,312 B2
(45) Date of Patent: Oct. 20, 2009

(54) FLUID EJECTION DEVICE WITH FEEDBACK CIRCUIT

(75) Inventor: John Wade, Ramona, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 160 days.

(21) Appl. No.: 11/706,618

(22) Filed: Feb. 12, 2007

(65) Prior Publication Data

US 2007/0146435 A1 Jun. 28, 2007

Related U.S. Application Data

(62) Division of application No. 10/789,189, filed on Feb. 27, 2004, now Pat. No. 7,175,248.

(51) Int. Cl.
*B41J 29/38* (2006.01)

(52) U.S. Cl. ..... 347/10; 347/14

(58) Field of Classification Search ..... 347/10, 347/14

See application file for complete search history.

(56) References Cited

U.S. PATENT DOCUMENTS

| | | | | |
|---|---|---|---|---|
| 4,400,709 | A | 8/1983 | de Kermadec et al. | |
| 4,449,137 | A | 5/1984 | Inui et al. | |
| 4,710,783 | A | 12/1987 | Caine et al. | |
| 4,812,673 | A | 3/1989 | Burchett | |
| 4,838,157 | A | 6/1989 | Signore, II | |
| 4,947,192 | A | 8/1990 | Hawkins et al. | |
| 5,083,137 | A | 1/1992 | Badyal et al. | |
| 5,477,245 | A * | 12/1995 | Fuse | 347/10 |
| 6,068,363 | A * | 5/2000 | Saito | 347/17 |
| 6,183,056 | B1 | 2/2001 | Corrigan et al. | |
| 6,215,513 | B1 | 4/2001 | Ashikaga | |
| 6,217,147 | B1 | 4/2001 | Holstun | |
| 6,224,195 | B1 | 5/2001 | Maru et al. | |
| 6,302,507 | B1 | 10/2001 | Prakash et al. | |
| 6,315,381 | B1 | 11/2001 | Wade et al. | |
| 6,334,660 | B1 | 1/2002 | Holstun et al. | |
| 6,361,153 | B1 | 3/2002 | Wafler | |
| 6,478,396 | B1 | 11/2002 | Schloeman et al. | |
| 6,523,922 | B2 | 2/2003 | Hirayama | |
| 6,659,581 | B2 | 12/2003 | Schloeman et al. | |
| 2001/0033305 | A1 | 10/2001 | Tamura | |
| 2002/0093544 | A1 | 7/2002 | Schloeman et al. | |

FOREIGN PATENT DOCUMENTS

| | | |
|---|---|---|
| EP | 0499373 | 8/1992 |

(Continued)

*Primary Examiner*—Julian D Huffman

(57) ABSTRACT

A fluid ejection assembly includes drop ejecting elements arranged in zones, with each zone having at least one drop ejecting element, wherein the drop ejecting elements of each zone are configured to conduct electrical current between a corresponding supply voltage and a corresponding reference voltage. Up to all drop ejecting elements of a group of the drop ejecting elements are enabled to conduct at a given time, with each conducting drop ejecting element of the enabled group having a corresponding drop ejecting voltage. A zone controller is configured to provide a corresponding desired supply voltage for each zone based on at least one corresponding zone parameter of each zone. An energy controller is configured to couple across each conducting drop ejecting element of the enabled group and regulate the supply voltage for each zone based on selected corresponding drop ejecting voltages and on each zone's corresponding desired supply voltage.

18 Claims, 11 Drawing Sheets

FOREIGN PATENT DOCUMENTS

| | | |
|---|---|---|
| EP | 1004442 | 5/2000 |
| EP | 1103380 | 5/2001 |
| JP | 05-016366 | 1/1993 |
| JP | 06-9954 | 2/1994 |
| JP | 06-198869 | 7/1994 |
| JP | 2001-138518 | 5/2001 |
| JP | 2003182114 | 7/2003 |
| JP | 2003-165933 | 10/2003 |
| JP | 2004-025870 | 1/2004 |
| WO | PCT/US2005/004994 | 5/2005 |

* cited by examiner

FLUID EJECTION DEVICE WITH FEEDBACK CIRCUIT

CROSS-REFERENCE TO RELATED APPLICATIONS

This application is a Divisional of U.S. patent application Ser. No. 10/789,189, filed on Feb. 27, 2004 now U.S. Pat. No. 7,175,248, which is incorporated herein by reference.

BACKGROUND

An inkjet printing system, as one embodiment of a fluid ejection system, may include a printhead assembly, an ink supply assembly which supplies liquid ink to the printhead assembly, and a controller which controls the printhead assembly. The printhead assembly, as one embodiment of a fluid ejection device, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead assembly and the print medium are moved relative to each other.

Typically, the printhead assembly ejects the ink drops through the nozzles by rapidly heating a small volume of ink located in vaporization chambers with small electric heaters, such as thin film resistors, often referred to as firing resistors. Heating the ink causes the ink to vaporize and be ejected from the nozzles. Typically, for one dot of ink, a remote printhead controller, typically located as part of the processing electronics of a printer, controls activation of an electrical current from a power supply external to the printhead assembly. The electrical current is passed through a selected firing resistor to heat the ink in a corresponding selected vaporization chamber.

Typically, firing resistors are connected to the power supply via shared current carrying paths. One characteristic of such a configuration is that as different numbers of firing resistors are energized to print various forms of data, different currents flow resulting in different voltage drops across parasitic resistances of the current carrying paths. Consequently, even though the power supply voltage may be held constant, voltage provided to a given firing resistor and the resulting energy produced may vary. Furthermore, if the power supply voltage is maintained at a level high enough to accommodate the worst case parasitic voltage drop occurring when a maximum number of firing resistors are energized, a firing resistor may be over-energized in a case where only one firing resistor is energized. As a result, energy control is a beneficial feature in inkjet printheads to insure that neither too little, nor too much energy is delivered to a firing resistor. Too little energy may cause print quality degradation, while too much energy may shorten firing resistor life.

One approach employed to correct this problem is to provide voltage regulators on a printhead assembly integrated circuit chip for groups of firing resistors. However, the voltage regulators dissipate unwanted power and generally require factory calibration to be effective. Other approaches compensate for firing resistor power variations by using on-chip voltage sensing and varying a firing pulse width for a group of firing resistors conducting at a same instant to thereby hold energy substantially constant. However, while the energy is constant, power is unregulated and can cause firing resistor failure if it becomes excessive.

Printing systems, particularly wide-array inkjet printing systems having long current-carrying paths and correspondingly high parasitic resistance values, would benefit from an improved energy control scheme.

DETAILED DESCRIPTION

In the following Detailed Description, reference is made to the accompanying drawings which form a part hereof, and in which is shown by way of illustration specific embodiments in which the invention may be practiced. In this regard, directional terminology, such as "top," "bottom," "row," "column," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
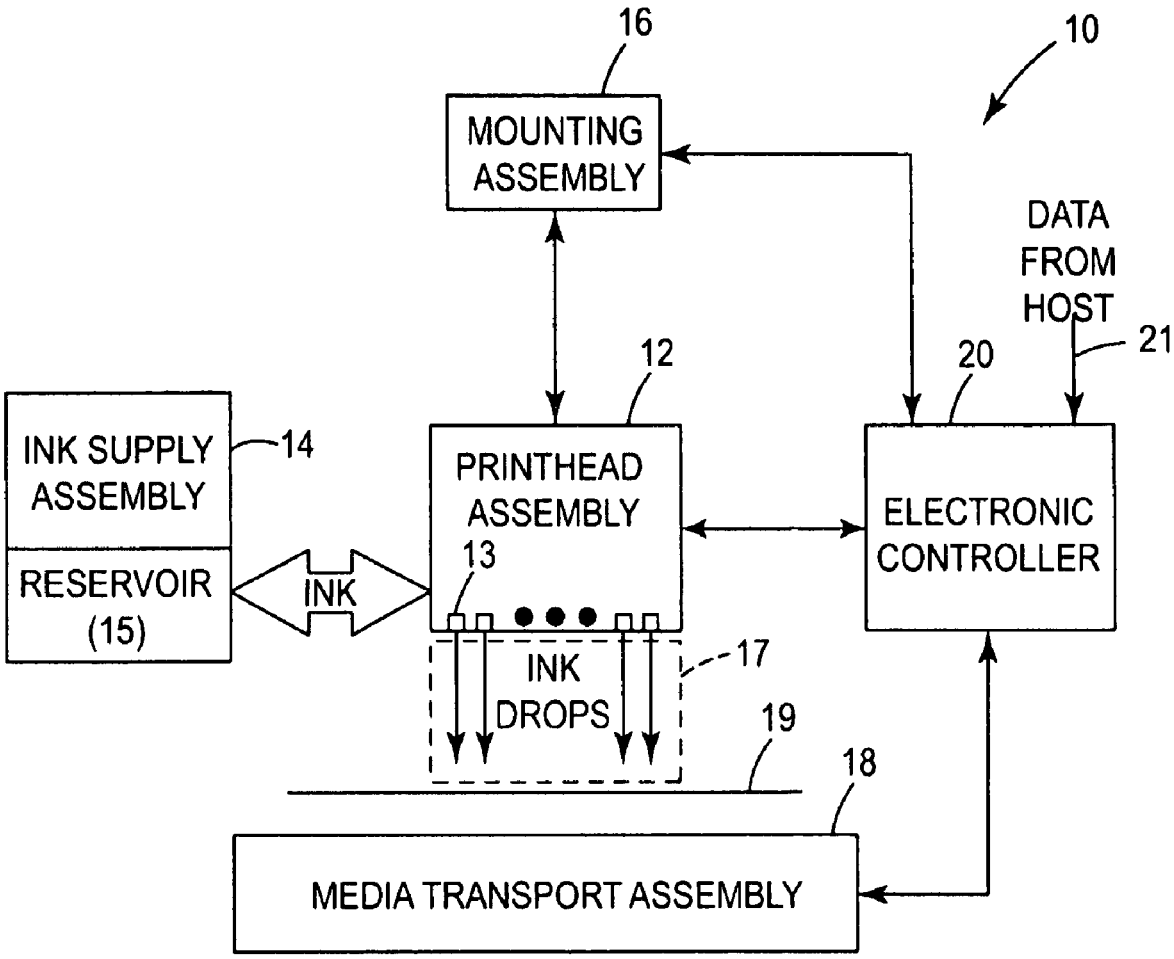
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection device, such as a printhead assembly 12, and a fluid supply assembly, such as an ink supply assembly 14. In the illustrated embodiment, inkjet printing system 10 also includes a mounting assembly 16, a media transport assembly 18, and a controller 20.

Printhead assembly 12, as one embodiment of a fluid ejection device, may be formed according to an embodiment of the present invention and ejects drops of ink, including one or more colored inks or UV readable inks, through a plurality of orifices or nozzles 13. While the following description refers to the ejection of ink from printhead assembly 12, it is understood that other liquids, fluids, or flowable materials, including clear fluid, may be ejected from printhead assembly 12. The types of fluids used will depend on the application for which the fluid ejection device is to be used.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and/or print media 19 are moved relative to each other.

Print media 19 includes any type of suitable sheet-like material, such as paper, card stock, envelopes, labels, transparencies, Mylar, fabric, and the like. In one embodiment, print media 19 is a continuous form or continuous web print media 19. As such, print media 19 may include a continuous roll of unprinted paper.

Ink supply assembly 14, as one embodiment of a fluid supply assembly, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in a fluid jet or inkjet cartridge or pen. The inkjet cartridge is one embodiment of a fluid ejection device. In another embodiment, ink supply assembly 14 may be separate from printhead assembly 12 and supplies ink to printhead assembly 12 through an interface connection, such as a supply tube.

In one embodiment, mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. Print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Controller 20 communicates with printhead assembly 12, mounting assembly 16, and media transport assembly 18. Controller 20 receives data 21 from a host system, such as a computer, and may include memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, controller 20 provides control of printhead assembly 12 including timing control for ejection of ink drops from nozzles 13. As such, controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of controller 20 is located on printhead assembly 12. In another embodiment, logic and drive circuitry is located off printhead assembly 12.

Controller 20 may be implemented as a processor, logic elements, firmware, and software, or in any combination thereof.

Figure 2:
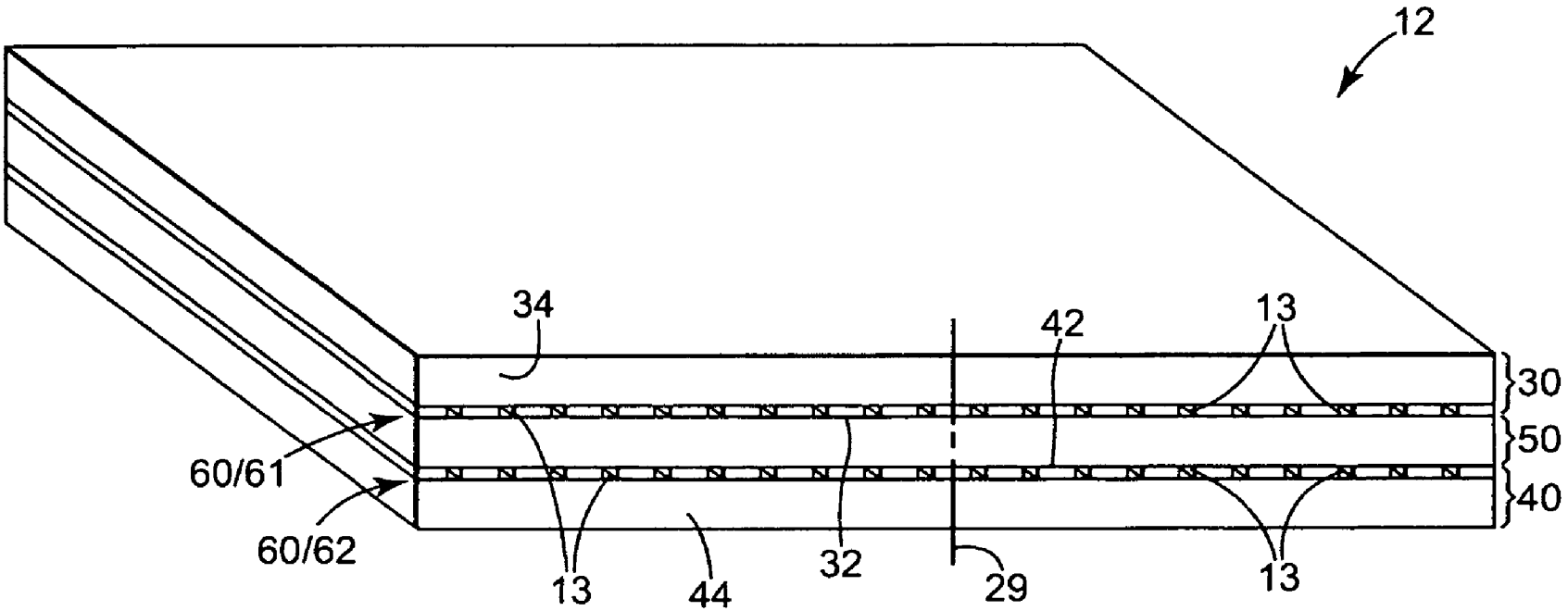
FIG. 2 is a schematic perspective view illustrating one embodiment of a printhead assembly according to the present invention and usable in the printing system of FIG. 1.

FIG. 2 illustrates one embodiment of a portion of printhead assembly 12. In one embodiment, printhead assembly 12 is a multi-layered assembly and includes outer layers 30 and 40, and at least one inner layer 50. Outer layers 30 and 40 have a face or side 32 and 42, respectively, and an edge 34 and 44, respectively, contiguous with the respective side 32 and 42. Outer layers 30 and 40 are positioned on opposite sides of inner layer 50 such that sides 32 and 42 face inner layer 50 and are adjacent inner layer 50. As such, inner layer 50 and outer layers 30 and 40 are stacked along an axis 29.

As illustrated in the embodiment of FIG. 2, inner layer 50 and outer layers 30 and 40 are arranged to form one or more rows 60 of nozzles 13. Rows 60 of nozzles 13 extend, for example, in a direction substantially perpendicular to axis 29. As such, in one embodiment, axis 29 represents a print axis or axis of relative movement between printhead assembly 12 and print media 19. Thus, a length of rows 60 of nozzles 13 establishes a swath height of printhead assembly 12. In one embodiment, rows 60 of nozzles 13 span a distance less than approximately two inches. In another embodiment, rows 60 of nozzles 13 span a distance greater than approximately two inches.

In one embodiment, inner layer 50 and outer layers 30 and 40 form two rows 61 and 62 of nozzles 13. More specifically, inner layer 50 and outer layer 30 form row 61 of nozzles 13 along edge 34 of outer layer 30, and inner layer 50 and outer layer 40 form row 62 of nozzles 13 along edge 44 of outer layer 40. As such, in one embodiment, rows 61 and 62 of nozzles 13 are spaced from and oriented substantially parallel to each other.

In one embodiment, as illustrated in FIG. 2, nozzles 13 of rows 61 and 62 are substantially aligned. More specifically, each nozzle 13 of row 61 is substantially aligned with one nozzle 13 of row 62 along a print line oriented substantially parallel to axis 29. As such, the embodiment of FIG. 2 provides nozzle redundancy since fluid (or ink) can be ejected through multiple nozzles along a given print line. Thus, a defective or inoperative nozzle can be compensated for by another aligned nozzle. In addition, nozzle redundancy provides the ability to alternate nozzle activation amongst aligned nozzles.

Figure 3:
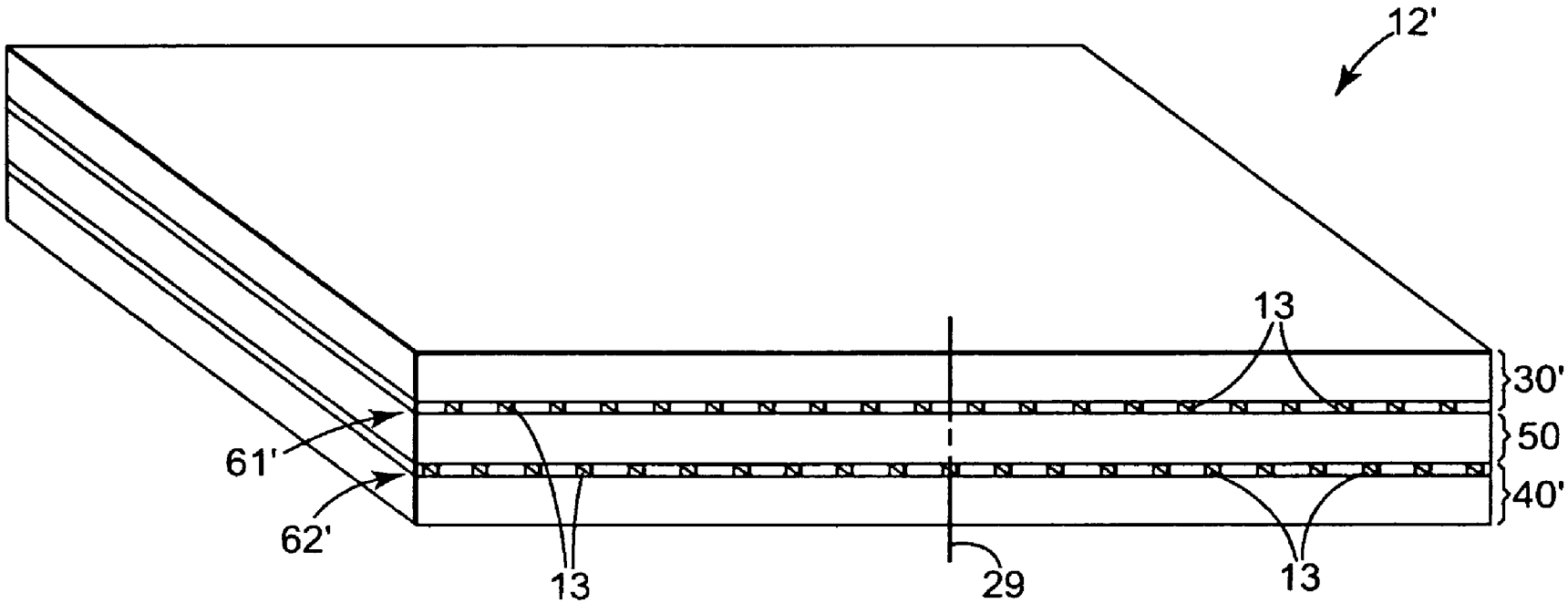
FIG. 3 is a schematic perspective view illustrating another embodiment of the printhead assembly of FIG. 2.

FIG. 3 illustrates another embodiment of a portion of printhead assembly 12. Similar to printhead assembly 12, printhead assembly 12' is a multi-layered assembly and includes outer layers 30' and 40', and inner layer 50. In addition, similar to outer layers 30 and 40, outer layers 30' and 40' are positioned on opposite sides of inner layer 50. As such, inner layer 50 and outer layers 30' and 40' form two rows 61' and 62' of nozzles 13.

As illustrated in the embodiment of FIG. 3, nozzles 13 of rows 61' and 62' are offset. More specifically, each nozzle 13 of row 61' is staggered or offset from one nozzle 13 of row 62' along a print line oriented substantially parallel to axis 29. As such, the embodiment of FIG. 3 provides increased resolution since the number of dots per inch (dpi) that can be printed along a line oriented substantially perpendicular to axis 29 is increased.

Figure 4:
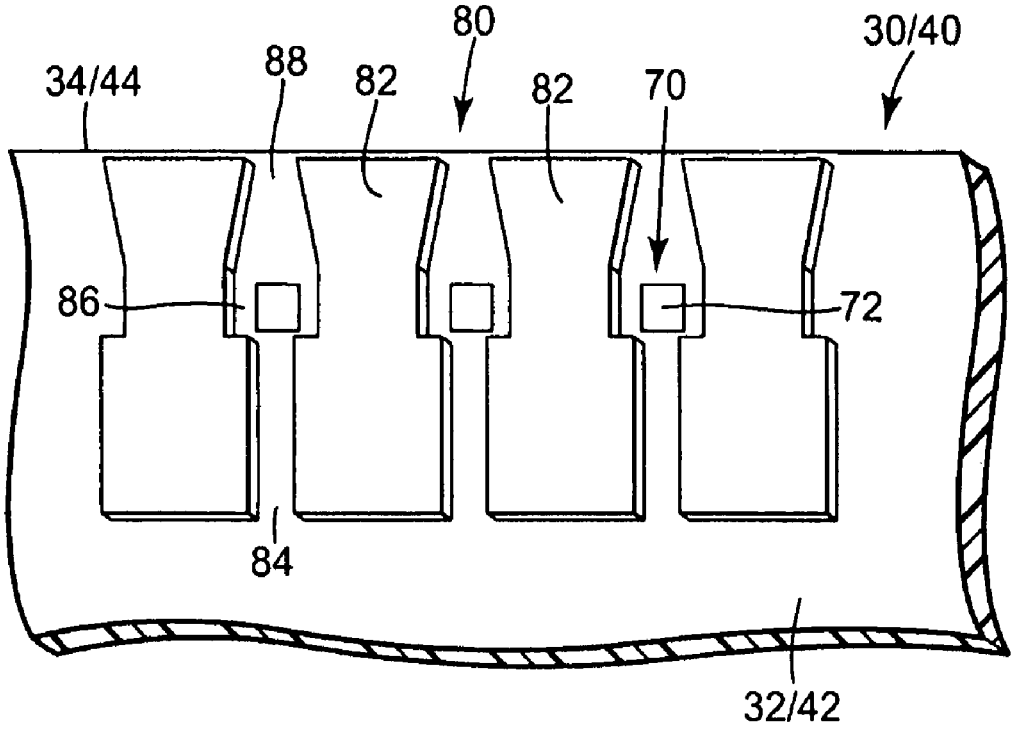
FIG. 4 is a schematic perspective view illustrating one embodiment of a portion of an outer layer of the printhead assembly of FIG. 2.

In one embodiment, as illustrated in FIG. 4, outer layers 30 and 40 (only one of which is illustrated in FIG. 4 and including outer layers 30' and 40') each include fluid ejecting elements 70 and fluid pathways 80 formed on sides 32 and 42, respectively. Fluid ejecting elements 70 and fluid pathways 80 are arranged such that fluid pathways 80 communicate with and supply fluid (or ink) to fluid ejecting elements 70. In one embodiment, fluid ejecting elements 70 and fluid pathways 80 are arranged in substantially linear arrays on sides 32 and 42 of respective outer layers 30 and 40. As such, all fluid ejecting elements 70 and fluid pathways 80 of outer layer 30 are formed on a single or monolithic layer, and all fluid ejecting elements 70 and fluid pathways 80 of outer layer 40 are formed on a single or monolithic layer.

In one embodiment, as described below, inner layer 50 (FIG. 2) has a fluid manifold or fluid passage defined therein which distributes fluid supplied, for example, by ink supply assembly 14 to fluid pathways 80 and fluid ejecting elements 70 formed on outer layers 30 and 40.

In one embodiment, fluid pathways 80 are defined by barriers 82 formed on sides 32 and 42 of respective outer layers 30 and 40. As such, inner layer 50 (FIG. 2) and fluid pathways 80 of outer layer 30 form row 61 of nozzles 13 along edge 34, and inner layer 50 (FIG. 2) and fluid pathways 80 of outer layer 40 form row 62 of nozzles 13 along edge 44 when outer layers 30 and 40 are positioned on opposite sides of inner layer 50.

As illustrated in the embodiment of FIG. 4, each fluid pathway 80 includes a fluid inlet 84, a fluid chamber 86, and a fluid outlet 88 such that fluid chamber 86 communicates with fluid inlet 84 and fluid outlet 88. Fluid inlet 84 communicates with a supply of fluid (or ink), as described below, and supplies fluid (or ink) to fluid chamber 86. Fluid outlet 88 communicates with fluid chamber 86 and, in one embodiment, forms a portion of a respective nozzle 13 when outer layers 30 and 40 are positioned on opposite sides of inner layer 50.

In one embodiment, each fluid ejecting element 70 includes a firing resistor 72 formed within fluid chamber 86 of a respective fluid pathway 80. Firing resistor 72 is, for example, any element which, when energized, heats fluid within fluid chamber 86 to produce a bubble within fluid chamber 86 and generate a droplet of fluid which is ejected through nozzle 13. As such, in one embodiment, a respective fluid chamber 86, firing resistor 72, and nozzle 13 form a drop generator of a respective fluid ejecting element 70.

In one embodiment, during operation, fluid flows from fluid inlet 84 to fluid chamber 86 where droplets of fluid are ejected from fluid chamber 86 through fluid outlet 88 and a respective nozzle 13 upon activation of a respective firing resistor 72. As such, droplets of fluid are ejected substantially parallel to sides 32 and 42 of respective outer layers 30 and 40 toward a medium. Accordingly, in one embodiment, printhead assembly 12 constitutes an edge or side-shooter design.

Figure 5:
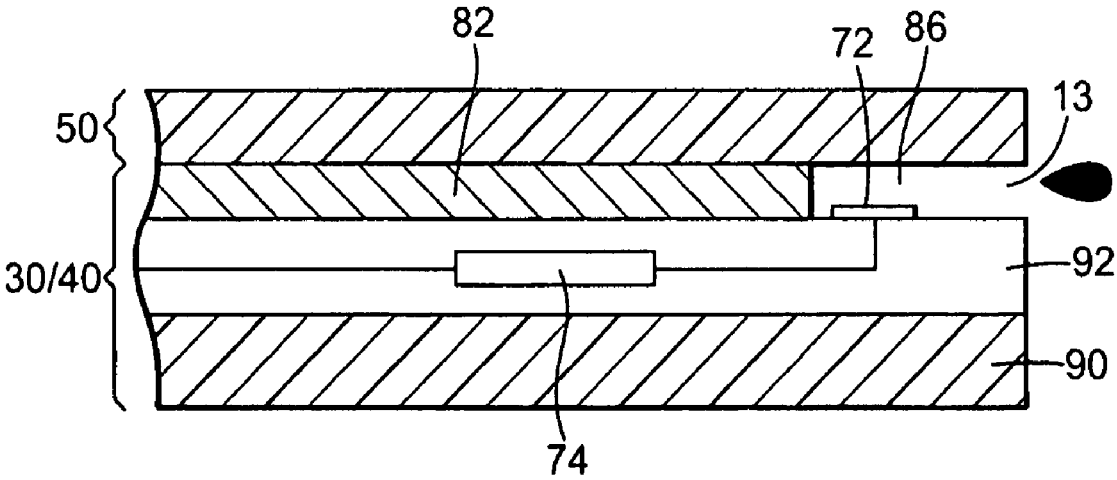
FIG. 5 is a schematic cross-sectional view illustrating one embodiment of a portion of the printhead assembly of FIG. 2.

In one embodiment, as illustrated in FIG. 5, outer layers 30 and 40 (only one of which is illustrated in FIG. 5 and including outer layers 30' and 40') each include a substrate 90 and a thin-film structure 92 formed on substrate 90. As such, firing resistors 72 of fluid ejecting elements 70 and barriers 82 of fluid pathways 80 are formed on thin-film structure 92. As described above, outer layers 30 and 40 are positioned on opposite sides of inner layer 50 to form fluid chamber 86 and nozzle 13 of a respective fluid ejecting element 70.

In one embodiment, inner layer 50 and substrate 90 of outer layers 30 and 40 each include a common material. As such, a coefficient of thermal expansion of inner layer 50 and outer layers 30 and 40 is substantially matched. Thus, thermal gradients between inner layer 50 and outer layers 30 and 40 are minimized. Example materials suitable for inner layer 50 and substrate 90 of outer layers 30 and 40 include glass, metal, a ceramic material, a carbon composite material, a metal matrix composite material, or any other chemically inert and thermally stable material.

In one embodiment, inner layer 50 and substrate 90 of outer layers 30 and 40 include glass such as Corning® 1737 glass or Corning® 1740 glass. In one embodiment, when inner layer 50 and substrate 90 of outer layers 30 and 40 include a metal or metal matrix composite material, an oxide layer may be formed on the metal or metal matrix composite material of substrate 90.

In one embodiment, thin-film structure 92 includes drive circuitry 74 for fluid ejecting elements 70. Drive circuitry 74 provides, for example, power, ground, and control logic for fluid ejecting elements 70 including, more specifically, firing resistors 72.

In one embodiment, thin-film structure 92 includes one or more passivation or insulation layers formed, for example, of silicon dioxide, silicon carbide, silicon nitride, tantalum, poly-silicon glass, or other suitable material. In addition, thin-film structure 92 also includes one or more conductive layers formed, for example, by aluminum, gold, tantalum, tantalum-aluminum, or other metal or metal alloy. In one embodiment, thin-film structure 92 includes thin-film transistors which form a portion of drive circuitry 74 for fluid ejecting elements 70.

As illustrated in the embodiment of FIG. 5, barriers 82 of fluid pathways 80 are formed on thin-film structure 92. In one embodiment, barriers 82 are formed of a non-conductive material compatible with the fluid (or ink) to be routed through and ejected from printhead assembly 12. Example materials suitable for barriers 82 include a photo-imageable polymer and glass. The photo-imageable polymer may include a spun-on material, such as SU8, or a dry-film material, such as DuPont Vacrel®.

As illustrated in the embodiment of FIG. 5, outer layers 30 and 40 (including outer layers 30' and 40') are joined to inner layer 50 at barriers 82. In one embodiment, when barriers 82 are formed of a photo-imageable polymer or glass, outer layers 30 and 40 are bonded to inner layer 50 by temperature and pressure. Other suitable joining or bonding techniques, however, can also be used to join outer layers 30 and 40 to inner layer 50.

Methods for fabricating thin-film transistor arrays on monolithic structures are disclosed and discussed in more detail in U.S. Pat. No. 4,960,719 entitled "Method for Producing Amorphous Silicon Thin Film Transistor Array Substrate," and in U.S. Pat. No. 6,582,062 entitled "Large Thermal Ink Jet Nozzle Array Printhead," both of which are herein incorporated by reference in their entirety as if fully set forth herein.

Feedback Circuit

Figure 6:
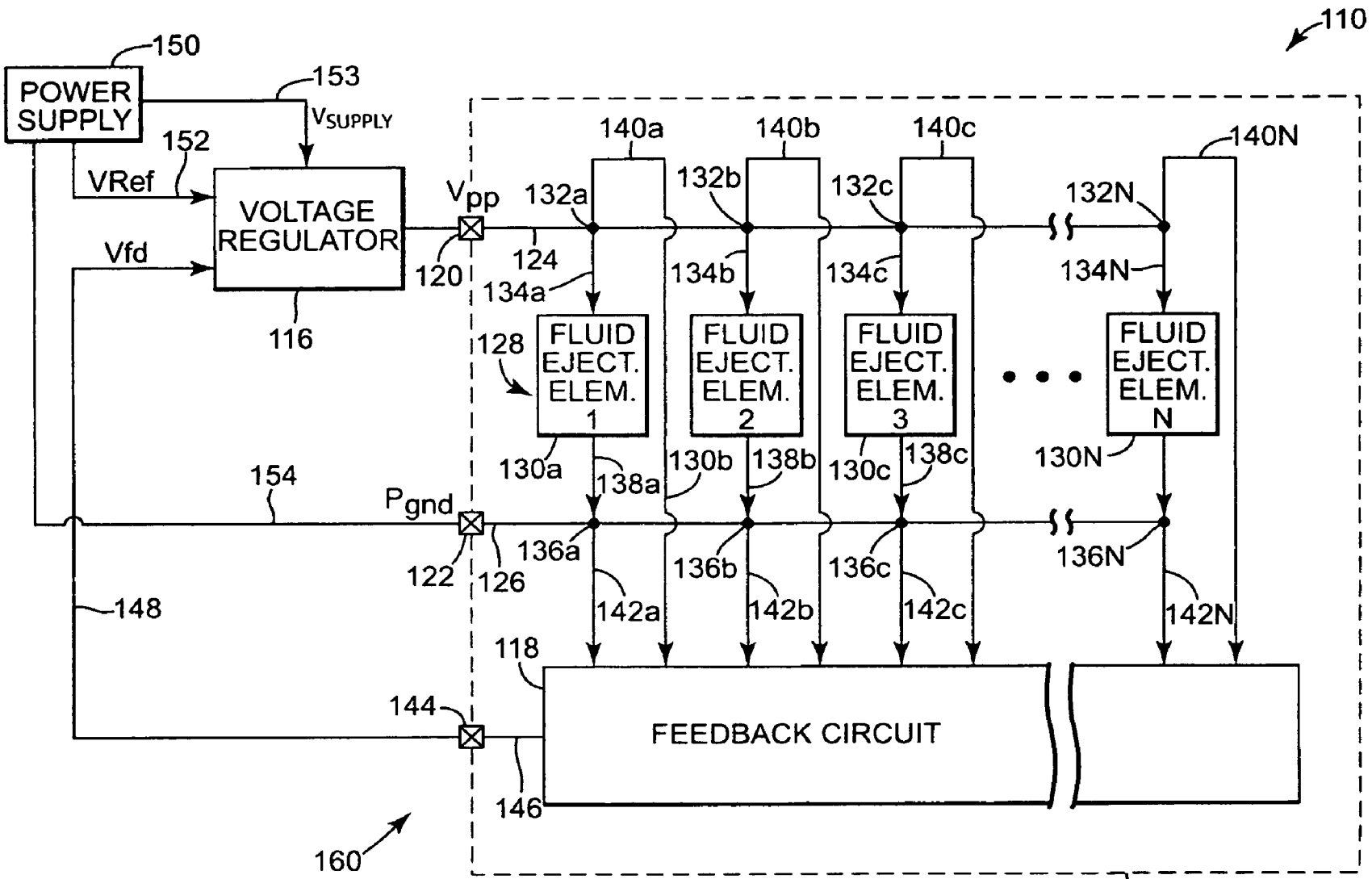
FIG. 6 is a block diagram illustrating a portion of one embodiment of a wide array inkjet printing system according to the present invention.

FIG. 6 is a block diagram illustrating a portion of one embodiment of a wide array inkjet printing system 110 according to the present invention. Printing system 110 includes a printhead assembly 112 and a voltage regulator 116, with printhead assembly 112 further including a feedback circuit 118. In one embodiment, as illustrated, feedback circuit 118 may be coupled to a portion of the drive circuitry 74 (FIG. 5) of printhead assembly 112. Drive circuitry 74 provides, for example, power, ground, and control logic for fluid ejecting elements 70 including, more specifically, firing resistors 72. Printhead assembly 112 receives a power supply voltage ($V_{pp}$) from voltage regulator 116 at $V_{pp}$ node 120 and couples to a corresponding power ground ($P_{gnd}$) at ground node 122. A $V_{pp}$ supply path 124 is coupled to $V_{pp}$ node 120 to supply $V_{pp}$ within printhead assembly 112. A power ground path 126 coupled to ground node 122 to provide printhead assembly 112 with a ground path.

Printhead assembly 112 further includes fluid ejecting elements 70 comprising a row 128 of N fluid ejecting elements, identified as fluid ejecting elements 130*a* to 130N. Each fluid ejecting element 130 is coupled to $V_{pp}$ supply path 124 at a corresponding node 132*a* to 132N via a corresponding power path 134*a* to 134N and to ground 126 at a corresponding node 136*a* to 136N via a corresponding ground path 138*a* to 138N.

Feedback circuit 118 is coupled to measure the voltage at each fluid ejecting element at nodes 132*a* to 132N and 136*a* to 136N via corresponding paths 140*a* to 140N and 142*a* to 142N. Feedback circuit 118 is coupled to a voltage feedback node 144 via a path 146. Voltage regulator 116 is coupled to feedback node 144 via a path 148, receives a power supply reference voltage ($V_{Ref}$) and a power supply voltage ($V_{SUPPLY}$) respectively via paths 152 and 153 from a power supply 150, receives $V_{pp}$ via path 153, and is coupled to $P_{gnd}$ at ground node 122 via path 154.

Together, voltage regulator 116 and feedback circuit 118 form a control loop 160. In one embodiment, as illustrated, voltage regulator 116 may be external to printhead assembly 112. In one embodiment, voltage regulator 116 forms a portion of controller 20 (see FIG. 1). In one embodiment, voltage regulator 116 may be internal to and forms a part of printhead assembly 112.

Printing system 110 employs control loop 160 to make $V_{pp}$ voltage corrections to compensate for varying parasitic resistances across printhead assembly 112 and load variations due to differing numbers of fluid ejecting elements 130*a* to 130N being fired at a given time to hold a voltage of the firing fluid ejecting elements at a substantially constant level. Printhead assembly 112 is configured such that a subgroup of the N fluid ejecting elements may be enabled to conduct simultaneously with each conducting fluid ejecting element of the subgroup conducting electrical current from $V_{pp}$ supply path 124 to power ground path 126 in order to operate or activate the fluid ejecting element so as to cause ink to be ejected from it. Due to varying parasitic resistances along $V_{pp}$ supply path 124 and power ground path 126, a different voltage may occur across each conducting fluid ejecting element.

Feedback circuit 118 is configured to couple across each conducting fluid ejecting element via the appropriate corresponding power paths 134*a* to 134N and ground paths 138*a* to 138N. Feedback circuit 118 provides a feedback voltage ($V_{fd}$) at feedback node 144 wherein $V_{fd}$ is substantially equal to an average of the different voltages occurring at each conducting fluid ejecting element and may be different from the voltage applied across nodes 120 and 122.

Voltage regulator 116 receives $V_{fd}$ via path 148 and provides power supply voltage $V_{pp}$ based on comparison of $V_{fd}$ to $V_{Ref}$ received via a path 152. When $V_{fd}$ is less than $V_{Ref}$, voltage regulator 116 raises $V_{pp}$ provided to $V_{pp}$ node 120. Conversely, when $V_{fd}$ exceeds $V_{pp}$, voltage regulator 116 decreases $V_{pp}$ provided to $V_{pp}$ node 120. In this fashion, voltage regulator 116 provides and maintains to fluid ejecting elements that are ejecting ink a power supply voltage $V_{pp}$ that is substantially equal to $V_{Ref}$, via $V_{pp}$ node 120.

By making power supply voltage corrections to compensate for varying parasitic resistances across printhead assembly 112, inkjet printing system 110 employing control loop 160 according to the present invention delivers a substantially constant voltage to the fluid ejecting elements 130 that are firing, regardless of the parasitic resistances between the fluid ejecting elements and nodes 120, 122, and regardless of the number of fluid ejecting elements conducting simultaneously. As a result, a substantially constant energy range is delivered to the individual fluid ejecting elements 130, when they are ejecting. This reduces excess energy and, therefore, waste heat which might otherwise limit frequency response, i.e. the time between ejections by an individual fluid ejecting element 130, and the life of fluid ejecting elements 130. Furthermore, there is likely to be less variance in weight or volume between drops of fluid (i.e., ink) ejected by different fluid ejecting elements 130.

Figure 7:
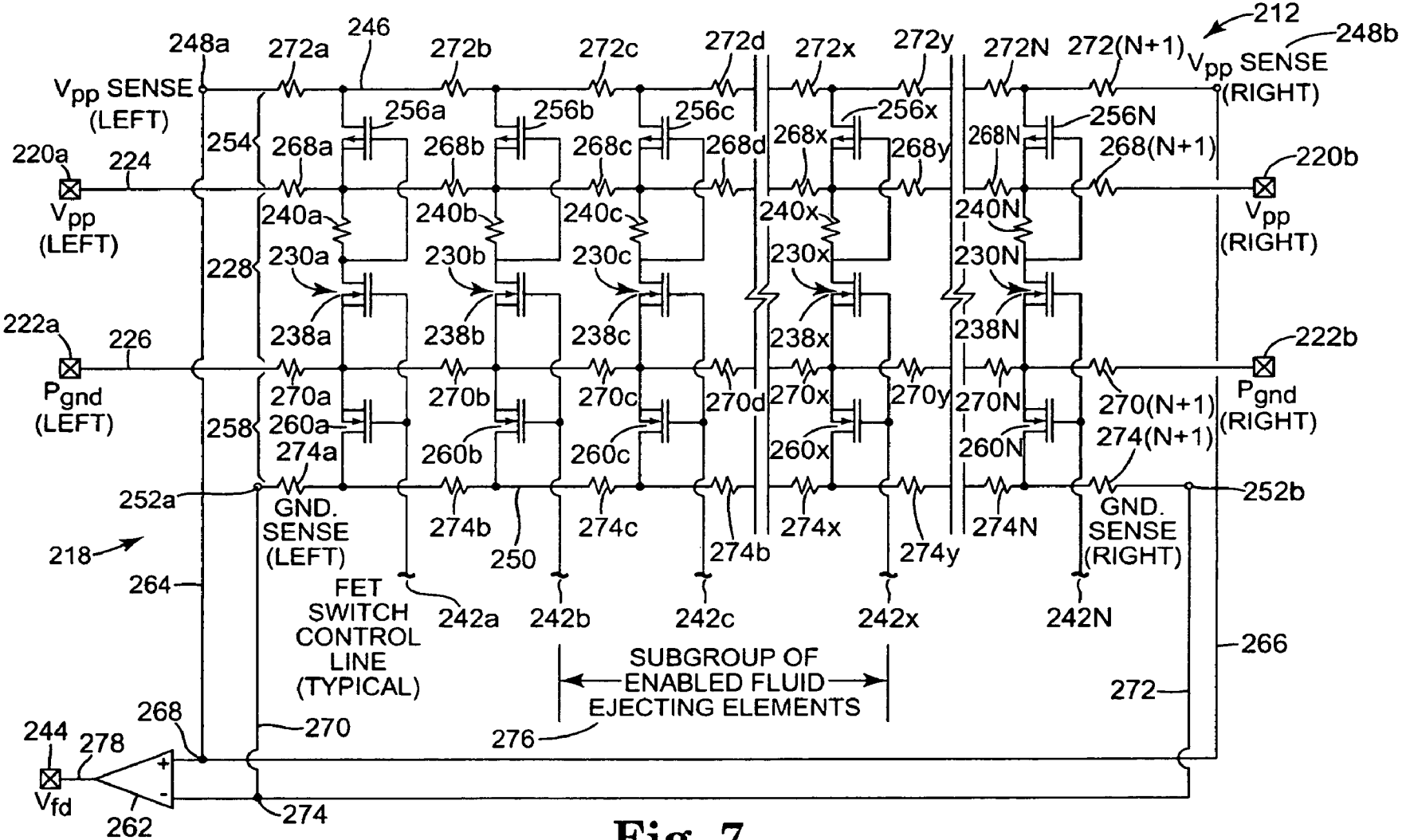
FIG. 7 is a schematic diagram illustrating a portion of one embodiment of a printhead assembly according to the present invention.

FIG. 7 is a schematic diagram illustrating a portion of one embodiment of printhead assembly 212 having a feedback circuit 218 according to the present invention. Printhead assembly 212 receives a power supply voltage ($V_{pp}$) at $V_{pp}$ nodes 220*a* and 220*b* and couples to a power ground at power ground ($P_{gnd}$) nodes 222*a* and 222*b*. A $V_{pp}$ supply path 224 runs between $V_{pp}$ nodes 220*a* and 220*b* to internally supply $V_{pp}$ within printhead assembly 212. A power ground path 226 runs between $P_{gnd}$ nodes 222*a* and 222*b* to provide printhead assembly 212 with an internal ground path.

Printhead assembly 212 further includes a row 228 of N fluid ejecting elements 230*a* to 230N, each coupled between $V_{pp}$ supply path 224 and power ground path 226. In one embodiment, row 228 comprises a page wide row, i.e. one that may be substantially the width of a media that may be to have fluid ejected on it, of fluid ejecting elements. Each fluid ejecting element 230 comprises a switch, which is depicted as a field effect transistor (FET) 238, and a heater element, which is depicted as a firing resistor 240. Firing resistor 240 has a first terminal coupled to $V_{pp}$ supply path 224 and a second terminal. FET 238 has its source coupled to power ground path 226, its drain coupled to the second terminal of firing resistor 240, and receives a fire signal at its control gate via a control line 242. Each fluid ejecting element 230 is configured to eject a fluid, e.g. a droplet of ink, in response to the fire signal received via corresponding control line 242.

Feedback circuit 218 includes a $V_{pp}$ sense line 246 having a first end 248*a* and a second end 248*b* and a ground sense line 250 having a first end 252*a* and a second end 252*b*. Feedback circuit further includes a row 254 of P-channel $V_{pp}$ sense FETs 256*a* to 256N, a row 258 of N-channel ground sense FETs 260*a* to 260N, and a differential amplifier 262. Each of the $V_{pp}$ sense FETs 256 corresponds to a different one of the N fluid ejecting elements 230 and has its source coupled to the first terminal of a corresponding firing resistor 240, its drain coupled to $V_{pp}$ sense line 246, and its gate coupled to the second terminal of corresponding firing resistor 240. Similarly, each of the ground sense FETs 260 corresponds to a different one of the N fluid ejecting elements 230 has its source coupled to the source of corresponding FET 238, its drain coupled to ground sense line 250, and its control gate coupled to the corresponding control line 242.

Resistors 268 represent parasitic resistances of $V_{pp}$ supply path 224, and resistors 270 represent parasitic resistances of power ground path 226. Resistors 272 represent parasitic resistances of $V_{pp}$ sense line 246, and resistors 274 represent parasitic resistances of ground sense line 250.

The operation of printhead assembly 212 is described below. In one embodiment, a subgroup 276 of adjacent fluid ejecting elements 230 of row 228 is enabled to generate ink droplets at a given time via control lines 242. When a fluid ejecting element 230 is enabled to eject fluid and has corresponding image data to print, the fire signal via control line 242 switches on FET 238. This causes a resulting electrical current to flow through firing resistor 240 from $V_{pp}$ supply path 224 to power ground path 226.

In one embodiment, the number of enabled fluid ejecting elements 230 in subgroup 276 at a given time remains generally constant, but its composition changes at time intervals. For example, as illustrated in FIG. 7, the enabled fluid ejecting elements that comprise subgroup 276 are shifted from left-to-right across row 228 after a time interval, with one additional fluid ejecting element being enabled at the right end of the subgroup 276 while another fluid ejecting element is simultaneously disabled at the left end of the subgroup. In some embodiments, the time interval may correspond to each cycle of a system clock. By enabling and disabling fluid ejecting elements in this fashion, the number of enabled fluid ejecting elements in subgroup 276 remains generally constant, except at the ends of row 228. For example, the number of enabled fluid ejecting elements in subgroup 276 starts at one and grows to the constant number as subgroup 276 is shifted across row 228 starting from the left end. Conversely, the number of enabled fluid ejecting elements diminishes from the constant number to zero as subgroup 276 exits from the right end of row 228. While illustrated by FIG. 7 as being shifted from left-to-right, the fluid ejecting elements that comprise subgroup 276 could also be shifted from right-to-left across row 228.

The number of enabled fluid ejecting elements 230 within subgroup 276 that actually fire at a given time depends on the corresponding image data to be printed. Also, the equivalent parasitic resistances of $V_{pp}$ supply path 224 and power ground path 226 depends on the location of subgroup 276 along row 228. Thus, because the location of subgroup 276 along row 228 and the number of fluid ejecting elements 230 that actually fire at a given time are variables, the current flowing through and the voltage across each of the firing fluid ejecting elements can vary as well, due to the parasitic resistances. Feedback circuit 218 functions to provide to a voltage regulator, such as voltage regulator 116 (see FIG. 7), a feedback voltage ($V_{fd}$) that is substantially equal to an average of the voltages of the firing fluid ejecting elements 230 of subgroup 276 so that the voltage regulator can regulate $V_{pp}$ to adjust for the voltage drops due to the parasitic resistances of $V_{pp}$ supply path 224 and power ground path 226.

In the illustrated embodiment, subgroup 276 of enabled fluid ejecting elements 230 comprises fluid ejecting elements from 230*b* to 230*x*. For each enabled fluid ejecting 230 of subgroup 276 that receives a fire signal via FET switch control line 240 that causes FET 238 to switch on, the corresponding $V_{pp}$ sense FET 256 and ground sense FET 260 are also switched on and causing $V_{pp}$ sense line 246 and ground sense line 250 to be respectively connected to $V_{pp}$ supply path 224 and power ground path 226.

Due to finite "on" resistances of $V_{pp}$ sense FETs 256 and the parasitic resistances 272 of $V_{pp}$ sense line 246, a voltage approximately equal to an average of the voltages at the first terminal of firing resistor 240 of each of the conducting fluid ejecting elements 230 of subgroup 276 appears at the first and second ends, 248*a* and 248*b*, of $V_{pp}$ sense line 246. Similarly, due to finite "on" resistances of ground sense FETs 260 and the parasitic resistances 274 of ground sense line 250, a voltage approximately equal to an average of the voltages at the source of each FET 238 of the conducting fluid ejecting elements 230 of subgroup 276 is generated at the first and second ends, 252*a* and 252*b*, of ground sense line 250. Further averaging of the voltages is achieved by connecting the first and second ends 248*a* and 248*b* of $V_{pp}$ sense line 246 via paths 264 and 266 to a node 268, and the first and second ends 252*a* and 252*b* of ground sense line 250 via paths 270 and 272 to a node 274. Averaging errors will be small since the firing fluid ejecting elements 230 of subgroup 276 are tightly grouped along the length of row 228, and the parasitic resistances between fluid ejecting elements 230 of subgroup 276 are relatively small compared to the total parasitic resistance of $V_{pp}$ supply path 224.

Differential amplifier 262 receives the average of the voltages at the first terminal of firing resistor 240 of each of the conducting fluid ejecting elements 230 of subgroup 276 from node 268 at a non-inverting input terminal, and the average of the voltages at the source of each FET 238 of the conducting fluid ejecting elements 230 of subgroup 276 from node 274 at an inverting input terminal. Differential amplifier 262 may be a unity gain amplifier and provides a feedback voltage ($V_{fd}$) at a feedback node 244 via an output 278 equal to the difference between the voltages received at its non-inverting and inverting input terminals. Thus, $V_{fd}$ is substantially equal to an average of the voltages at the conducting fluid ejecting elements 230 of subgroup 276. $V_{fd}$ may be provided via feedback node 244 to a voltage regulator, such as voltage regulator 116.

Figure 8:
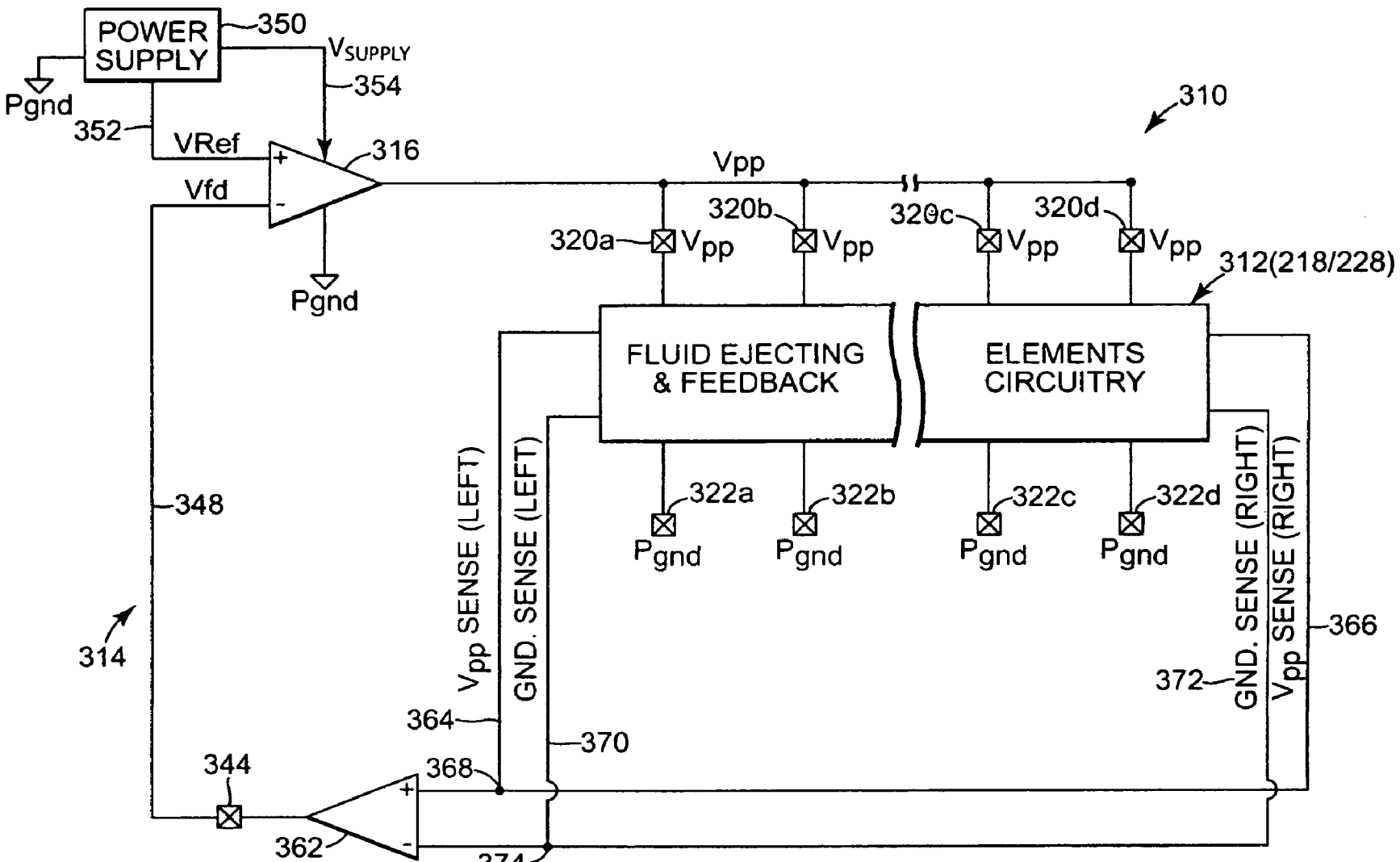
FIG. 8 is a block diagram illustrating generally a portion of one embodiment of a wide array inkjet printing system according to the present invention.

FIG. 8 is a block diagram illustrating generally a portion of one embodiment of a wide array inkjet printing system 310 including a printhead assembly 312 and having a control loop 314 according to the present invention. Printhead assembly 312 includes a row of fluid ejecting elements, a $V_{pp}$ sense line and sense FETs, and a ground sense line and sense FETs, such as feedback circuit 218 and row 228 of fluid ejecting elements as illustrated at 212 in FIG. 7. Control loop 314 includes a voltage regulator 316, and feedback circuit 218 further includes a differential amplifier 362. In the illustrated embodiment, voltage regulator 316 and differential amplifier 362 are not part of printhead assembly 312.

Printhead assembly 312 receives power supply voltage $V_{pp}$ from voltage regulator 316 at nodes 320*a* to 320*d* at intervals along the length of printhead assembly 312 and is coupled to ground nodes 322*a* to 322*d*, although the actual number of nodes and their location may vary. Feedback circuitry within printhead assembly 312 provides to non-inverting terminal of differential amplifier 362 via $V_{pp}$ sense lines 364 and 366, and node 368, an average of the voltages at the $V_{pp}$ power path side of the conducting fluid ejecting elements of printhead assembly 312. Similarly, feedback circuitry within printhead assembly 312 provides to inverting terminal of differential amplifier 362 via ground sense lines 370 and 372, and node 374, an average of the voltages at the power ground side of the conducting fluid ejecting elements of printhead assembly 312.

Differential amplifier 362 may be a unity gain amplifier and provides a feedback voltage ($V_{fd}$) at output 378 substantially equal to the difference between the voltages received at its non-inverting and inverting terminals. Thus, $V_{fd}$ is substantially equal to an average of the voltages at the conducting fluid ejecting elements of printhead assembly 312.

Voltage regulator 316 comprises an operational amplifier configured to operate as an error amplifier. Voltage regulator 316 receives $V_{fd}$ from differential amplifier 362 via path 348, and a reference voltage ($V_{Ref}$) and a supply voltage ($V_{SUPPLY}$) respectively via paths 352 and 354 from power supply 350. Voltage regulator 316 is further connected to power supply 350 at a positive voltage terminal via path 354 and to a ground at a negative voltage terminal. Voltage regulator 316 provides power supply voltage $V_{pp}$ based on comparing $V_{fd}$ to $V_{Ref}$. Voltage regulator 316 raises $V_{pp}$ when $V_{fd}$ is less than $V_{Ref}$ and lowers $V_{pp}$ when $V_{fd}$ exceeds $V_{Ref}$. Thus, voltage regulator 316 provides and maintains $V_{pp}$ of the firing elements at a level substantially equal to $V_{Ref}$.

FIGS. 9A to 9D are voltage graphs illustrating example operations of printhead assembly 212 to varying numbers and locations of conducting fluid ejecting elements based on P-Spice simulations. In each simulation, printhead assembly 212 comprises a row of 1,201 fluid ejecting elements, the "on" resistance of each $V_{pp}$ sense FET 256 and ground sense FET 260 is 30 ohms, each parasitic resistance 268, 270, 272, and 274 is 0.01 ohms, and the combined "on" resistance of each FET 238 and its corresponding firing resistor 240 is 100 ohms. Additionally, the power supply reference voltage ($V_{Ref}$), or desired voltage, is 35 volts. In each of the below described simulations, the actual average of voltages at the conducting fluid ejecting elements of the subgroup, is within 1.2% of the feedback voltage, $V_{fd}$.

Figure 9A:
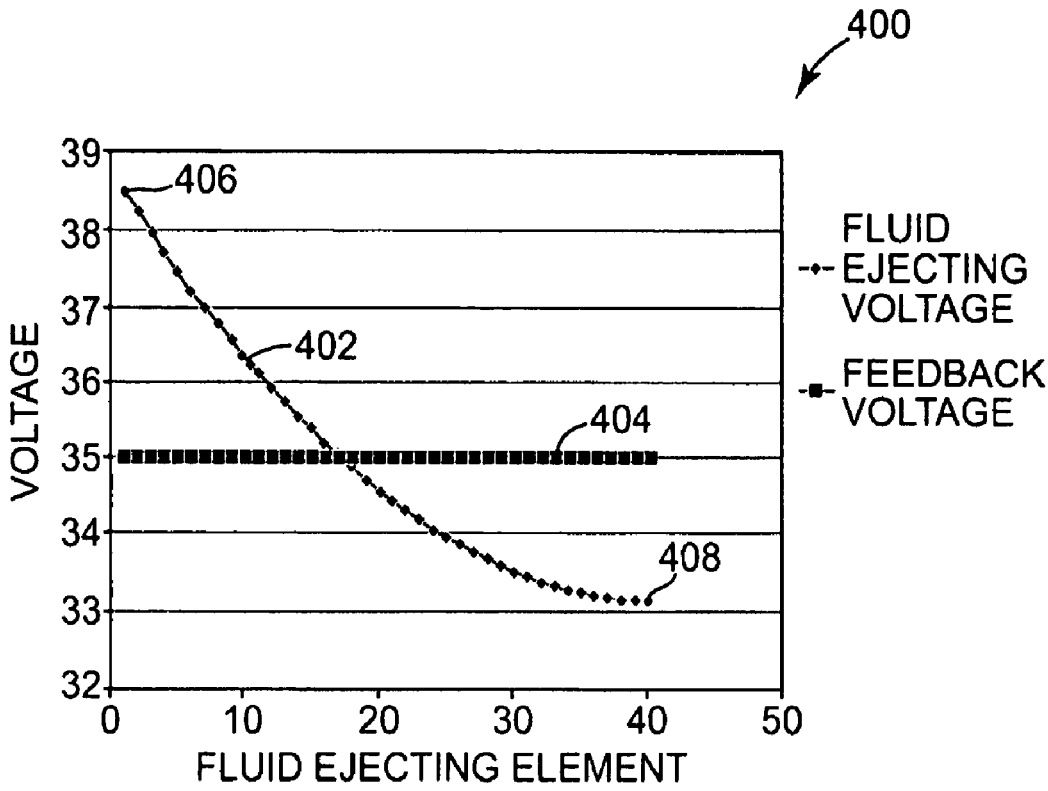
FIG. 9A is voltage graph illustrating an example operation of one embodiment of a printhead assembly according to the present invention.

FIG. 9A is a voltage graph 400 illustrating an example operation of printhead assembly 212 when subgroup 276 comprises 41 conducting fluid ejecting elements 230 located at the left end of row 228. Points on curve 402 represent the voltage at each of the conducting fluid ejecting elements and curve 404 represents the feedback voltage, $V_{fd}$. Each point along curve 402 represents the voltage level at one of the 41 conducting fluid ejecting elements with point 406 representing the voltage level at the left-most and point 408 representing the voltage level at the right-most fluid ejecting element of the subgroup.

Figure 9B:
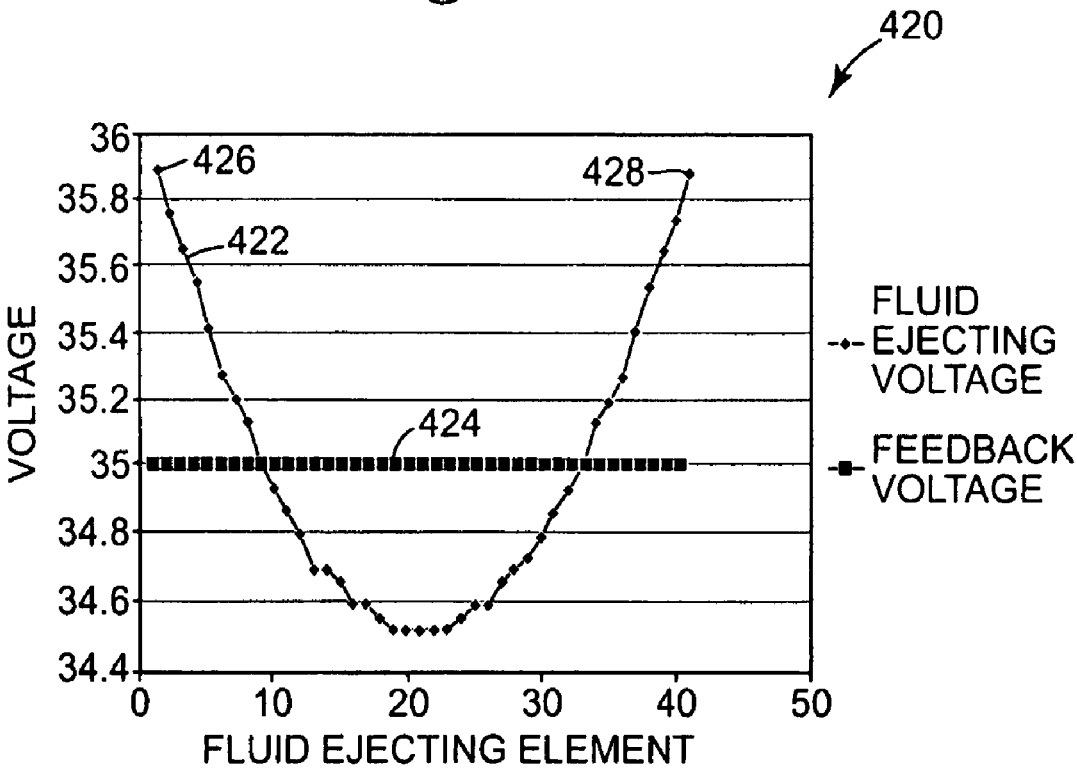
FIG. 9B is a voltage graph illustrating an example operation of one embodiment of a printhead assembly according to the present invention.

FIG. 9B is a voltage graph 420 illustrating an example operation of printhead assembly 212 when subgroup 276 comprises 41 conducting fluid ejecting elements 230 located at substantially the center of row 228. Curve 422 represents the voltage at each of the conducting fluid ejecting elements and curve 424 represents the feedback voltage, $V_{fd}$. Each point along curve 422 represents the voltage level at one of the 41 conducting fluid ejecting elements with point 426 representing the voltage level at the left-most and point 428 representing the voltage level at the right-most fluid ejecting element of the subgroup.

Figure 9C:
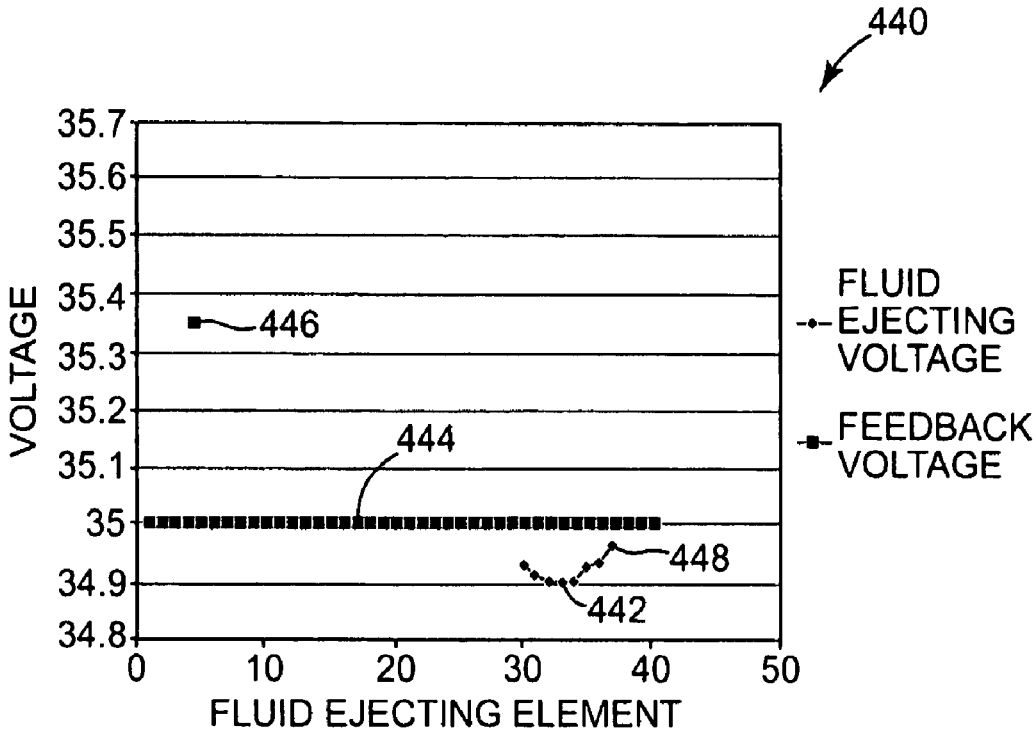
FIG. 9C is a voltage graph illustrating an example operation of one embodiment of a printhead assembly according to the present invention.

FIG. 9C is a voltage graph 440 illustrating an example operation of printhead assembly 212 when subgroup 276 comprises 9 separated conducting fluid ejecting elements 230 grouped around the center of row 228. Curve 442 represents the voltage at each of the conducting fluid ejecting elements and curve 444 represents the feedback voltage, $V_{fd}$. Each point along curve 442 represents the voltage level at one of the 9 conducting fluid ejecting elements with point 446 representing the voltage level at the left-most and point 448 representing the voltage level at the right-most fluid ejecting element of the subgroup.

Figure 9D:
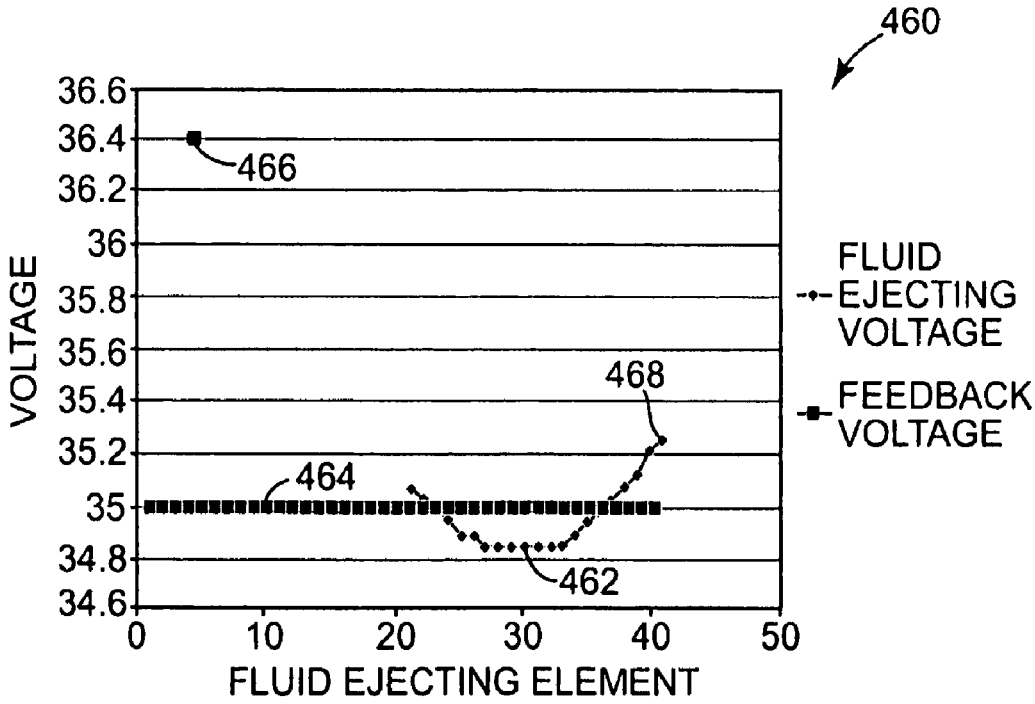
FIG. 9D is a voltage graph illustrating an example operation of one embodiment of a printhead assembly according to the present invention.

FIG. 9D is a graph 460 illustrating an example operation of printhead assembly 212 when subgroup 276 comprises 22 separated conducting fluid ejecting elements 230 located at substantially the center of row 228. Curve 462 represents the voltage at each of the conducting fluid ejecting elements and curve 464 represents the feedback voltage, $V_{fd}$. Each point along curve 462 represents the voltage level at one of the 9 conducting fluid ejecting elements with point 466 representing the voltage level at the left-most and point 468 representing the voltage level at the right-most fluid ejecting element of the subgroup.

FIGS. 9A through 9D illustrate graphically the voltage response of fluid ejection assembly 212 in maintaining feedback voltage $V_{fd}$ at 244, respectively illustrated as curves 404, 424, 444, and 464, at substantially a desired reference voltage $V_{Ref}$, in this case 35 volts, in spite of varying numbers and locations of conducting fluid ejection elements 230 along row 228. By maintaining the voltage at the individual fluid ejection elements 230 that are ejecting at substantially the desired reference voltage $V_{Ref}$, fluid ejection assembly 212 is able to deliver a substantially constant energy range to the individual fluid ejection elements 230 that are ejecting. This reduces excess energy and, therefore, waste heat energy which might otherwise limit frequency response, i.e. the time between ejections by and individual fluid ejection element 230, and the life of fluid ejection elements 230. Furthermore, there is likely to be less variance in size between drops of fluid ejected by different fluid ejection elements 230.

Zonal Voltage Control

Figure 10:
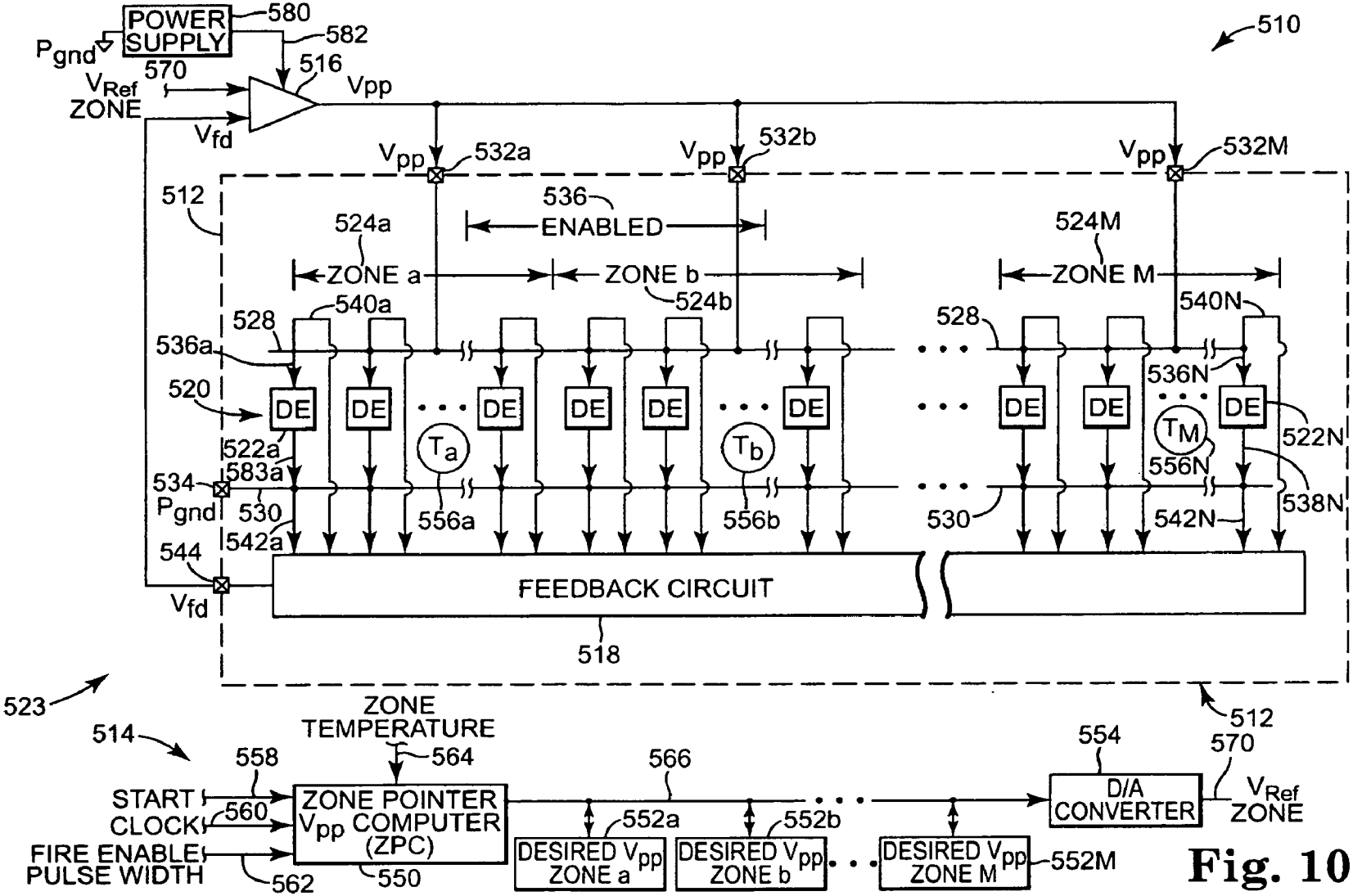
FIG. 10 is a block diagram illustrating a portion of one embodiment of an inkjet printing system employing zonal voltage control according to the present invention.

One characteristic of an array is that, during operation, different sections, or zones, of an array are typically at different temperatures. As a result, in a zone that is at an already elevated temperature, the ink does not require as much energy to be heated to a temperature to produce nucleation as ink in a cooler zone. If the same amount of energy is applied to each firing resistor of the array, those firing resistors in a zone at an already elevated temperature may become over-energized while those in a cooler zone may receive too little energy. Too little energy may cause print quality degradation, while too much energy may shorten an expected operating life of a firing resistor. As a result, energy control is a beneficial feature in inkjet printing systems to insure that neither too little, nor too much energy is delivered to a firing resistor. Energy control is particularly beneficial in wide array inkjet printing systems where larger distances increase the potential for thermal gradients FIG. 10 is a block and schematic diagram illustrating a portion of a wide array inkjet printing system 510 according to the present invention employing zonal voltage control for controlling energy provided to drop ejecting elements. Printing system 510 includes a printhead assembly 512, a zone controller 514, and a voltage regulator 516. Printhead assembly 512 further includes a feedback circuit 518 and a row 520 of N drop ejecting elements 522*a* to 522N. In one embodiment, as illustrated, feedback circuits 518 comprise a portion of the drive circuitry for printhead assembly 512. In one embodiment, as illustrated, voltage regulator 516 is external to printhead assembly 512. In one embodiment, voltage regulator 516 forms a portion of controller 20 (see FIG. 1). Together, voltage regulator 516 and feedback circuit 518 form an energy controller 523 that, in conjunction with zone controller 514, controls energy provided to drop ejecting elements 522 through zonal voltage control of printhead assembly 512.

Row 520 of N drop ejecting elements 522 is arranged into M drop ejecting zones, indicated as zone 524*a* to 524M, with each zone having at least one drop ejecting element. In one embodiment, zones 524*a* to 524M are arranged based on thermal gradients expected across row 520 of printhead assembly 512. The number of drop ejecting elements 522 may vary from zone to zone, but the total number of drop ejecting elements of drop ejecting zones 524*a* to 524M sums to N. In one embodiment, the number of drop ejecting elements 522 in each of the zones 524*a* to 524M is based on a level of control desired across row 520 of printhead assembly 512.

Printhead assembly 512 includes an internal $V_{pp}$ supply path 528 and a power ground path 530. $V_{pp}$ supply path 528 receives a power supply voltage $V_{pp}$ at various points along its length via a plurality of $V_{pp}$ input pins 532. As illustrated, power ground path 530 is coupled to a power ground pin 534. In other embodiments, power ground path 530 is coupled to a plurality of power ground pins.

In one embodiment, printhead assembly 512 is configured to print a row of N bits of image data in a print cycle, wherein each of the N bits of data corresponds to a different one of the N drop ejecting elements 522. In one embodiment, as described above by FIG. 7, a group 726 of adjacent drop ejecting elements is enabled to conduct simultaneously with each conducting drop ejecting elements 522 of group 526 conducting electrical current from $V_{pp}$ supply path 528 to power ground path 530 so as to cause an ink droplet to be ejected from it. To print the row of data, group 526 of enabled drop ejecting elements is shifted from left-to-right across row 520 by sequentially enabling one additional drop ejecting element 522 at the right end of group 526 and disabling one drop ejecting element 522 at the left end of group 526 after a time interval. In one embodiment, the time interval may correspond to each cycle of a system clock.

As illustrated, as group 526 is shifted from left-to-right across row 520, group 526 may comprise drop ejecting elements 522 from one or more of the drop ejecting zones 524. The number of enabled drop ejecting elements 522 within enabled group 526 that actually conduct, or fire, at a given time depends on the corresponding image data to be printed. Due to parasitic resistances of $V_{pp}$ supply path 528, as described above by FIG. 7, and the number of firing drop ejecting elements 522, the voltage across each conducting drop ejecting element 522 may vary.

In a fashion similar to that described above by FIG. 6 and FIG. 7, feedback circuit 518 is configured to couple across each conducting drop ejecting element 522 of group 526. Feedback circuit 518 provides a reference voltage ($V_{fd}$) at an output pin 544 that is substantially equal to an average of the voltages across each conducting drop ejecting element 522 of the enabled group 526 of drop ejecting elements.

Zone controller 514 includes a zone pointer/$V_{pp}$ computer (ZPC) 550, zone registers 552, and digital-to-analog (D/A) converters 554, with each zone register 552 and corresponding to a different one of the drop ejecting zones 524. Zone controller 514 further includes temperature sensors 556 located internally to printhead assembly 512, with each temperature sensor 556 being located proximate to and corresponding to a different one of the M drop ejecting zones 524. In other embodiments, each drop ejecting zone 524 may have multiple corresponding temperature sensors 556. Each temperature sensor 556 provides temperature data representative of the temperature of the drop ejecting elements 522 of its corresponding drop ejecting zone 524.

ZPC 550 receives a print cycle start signal at 558, a clock signal at 560, and a fire enable pulse width signal at 562 from a controller, such as controller 20 (see FIG. 1), wherein the fire enable pulse width signal indicates the number of adjacent enabled drop ejecting elements 522 comprising group 526. ZPC 550 also receives at 564 the temperature data from zone temperature sensors 556 located within printhead assembly 512. In one embodiment, as illustrated, zone controller 514, except for temperature sensors 556, is external to printhead assembly 512. In one embodiment, zone controller 514, except for temperature sensors 556, forms a portion of controller 20.

ZPC 550 determines a desired $V_{pp}$ supply voltage level for each drop ejecting zone 524, such that if the power supply voltage $V_{pp}$ provided to $V_{pp}$ supply path 528 is maintained at a value substantially equal the desired $V_{pp}$ corresponding to the drop ejecting zone 524 through which enable group 526 is passing, a near optimal amount of energy (i.e., neither too little, nor too much) will be provided to the conducting drop ejecting elements 522 of row 520. In one embodiment, ZPC 550 calculates the desired $V_{pp}$ for each drop ejecting zone 524 based on the width of the enabled group 526 received at 562 and on the temperature data received at 564 from each zone's corresponding temperature sensor 556. In other embodiments, ZPC 550 further bases the desired $V_{pp}$ calculation for each zone 524 based on the average resistance of the firing resistors of each drop ejecting zone 524 and on other factors that may affect the energy required by each zone's firing resistors, such as image data.

ZPC 550 places the calculated desired $V_{pp}$ level for each drop ejecting zone 524 in a corresponding zone register 552 via a path 566. D/A converter 554 is coupled to each of the zone registers 552 via path 566. D/A converter 554 receives the desired $V_{pp}$ value from the zone register 552 corresponding to the drop ejecting zone 524 through which enabled group 526 is about to pass and converts it to an analog reference voltage value ($V_{Ref}$) at 570.

In one embodiment, as illustrated, voltage regulator 516 comprises an operational amplifier configured to operate as an error amplifier. Voltage regulator 516 is connected to a power supply 580 at a positive voltage terminal via a path 582 and to ground at a negative voltage terminal. Voltage regulator 516 receives at an inverting terminal the feedback voltage $V_{fd}$ provided at output pin 544 by feedback circuit 518, and receives at a non-inverting terminal the reference voltage $V_{Ref}$ provided at 570 by the D/A converter 554.

Voltage regulator 516 provides a power supply voltage $V_{pp}$ via input pins 532 to the voltage supply path 528, wherein $V_{pp}$ is based on comparing $V_{Ref}$ to $V_{fd}$. When $V_{fd}$ is less than $V_{Ref}$, voltage regulator 516 raises $V_{pp}$ provided to $V_{pp}$ input pins 532. Conversely, When $V_{fd}$ exceeds $V_{Ref}$, voltage regulator 516 decreases $V_{pp}$ provided to $V_{pp}$ input pin 532. In this fashion, voltage regulator 516 provides and maintains to each conducting drop ejecting element a supply voltage $V_{pp}$ that is substantially equal to the $V_{Ref}$ of the drop ejecting zone 524 to which it corresponds and, thus, substantially equal to the desired $V_{pp}$ for its corresponding drop ejecting zone 524 as calculated by ZPC 550.

The operation of printing system 510 is described below. Prior to the start of a print cycle in which a row of N bits of image are to be printed, ZPC 550 receives the fire enable pulse width signal at 562 indicating the number of adjacent drop ejecting elements 522 that will constitute the enabled group 526 for the print cycle. ZPC 550 then determines a desired $V_{pp}$ supply voltage level for drop ejecting zone "a" 524*a* based on the pulse width signal 562 and temperature data for zone "a" 524*a* received from temperature sensor 556*a* via path 564. The desired $V_{pp}$ supply voltage level is a level that will provide a near optimal amount of energy to the drop ejecting elements of the zone such that the drop ejecting elements will generate a minimal amount of waste heat while still providing an ink droplet having a desired volume of ink. ZPC 550 then places the desired $V_{pp}$ level for zone a 524*a* in zone register 552*a*.

Just prior to the start of the print cycle, ZPC 550 "points" to the zone register 552*a* and provides the desired $V_{pp}$ supply voltage level for zone "a" 524*a* to D/A converter 554 via path 566. D/A converter 554 then converts the desired $V_{pp}$ supply voltage level to a corresponding analog voltage level $V_{Ref}$ at 570 and in-turn provides $V_{Ref}$ for zone "a" 524*a* to the non-inverting terminal of voltage regulator 516.

A start signal for the print cycle is then provided by controller 20 causing the group 526 of enabled drop ejecting elements 522 to being shifted from left-to-right across row 520, and voltage regulator 516 is provides $V_{pp}$ to voltage supply path that has a level based on a comparison of $V_{fd}$ to $V_{Ref}$ for zone "a" 524*a*. Upon receipt of the start signal at 558, ZPC 550 begins counting clock pulses of the system clock signal received at 560 and comparing the clock pulse count with a stored "zone map" in order to detect when enabled group 526 crosses from one zone to the next, such as from zone "a" 524*a* to zone "b" 524*b*.

During this time, ZPC 550 is computing a desired $V_{pp}$ supply voltage level for zone "b" 524*b* based on the pulse width signal received at 562 and on temperature data for zone "b" 524*b* received from temperature sensor 556*b* received via path 564. ZPC 550 then places the desired $V_{pp}$ supply voltage level for zone "b" 524*b* in zone register 552*b*. In one embodiment, when ZPC 550 detects that the first drop ejecting element 522 of drop ejecting zone "b" 524*b* has become part of enabled group 526, ZPC 550 "points" to zone register 552*b* and provides the desired $V_{pp}$ supply voltage level to D/A converter 554 via path 566. D/A converter then converts the desired $V_{pp}$ supply voltage level to a corresponding analog voltage level $V_{Ref}$ at 570. In-turn, D/A converter 554 then provides $V_{Ref}$ to the non-inverting terminal of voltage regulator 516 which then begins providing $V_{pp}$ to voltage supply path 528 that has a level based on a comparison of $V_{fd}$ to $V_{Ref}$ for zone "b" 524*b*.

Due to the gradual change in temperature gradients across row 520, it is generally not critical that the desired $V_{pp}$ voltage level provided to the non-inverting terminal be updated precisely when group 526 of enabled drop ejecting elements transitions from one drop ejecting zone 524 to another. Thus, in one embodiment, ZPC does not point to zone register 552*b* until a predetermined number of clock cycles after detecting that the first drop ejecting element 522 of drop ejecting zone "b" 524*b* has become part of enabled group 526. In another embodiment, ZPC points to zone register 552*b* a predetermined number of clock cycles before detecting that the first drop ejecting element 522 of drop ejecting zone "b" 524*b* has become part of enabled group 526.

The above process is repeated as group 526 of enabled drop ejecting elements 522 shifts through each drop ejecting zone 524 of row 520. Prior to the start signal for the next print cycle being received, ZPC 550 determines a desired $V_{pp}$ supply voltage level for zone "a" 524*a* using updated temperature data from temperature sensor 556*a* and stores the calculated value in zone register 552*a*. This process is then repeated for each subsequent print cycle.

By providing a $V_{pp}$ supply voltage level calculated in this fashion to each drop ejecting zone 524, energy controller 523 delivers an optimal amount of energy to the conducting drop ejecting elements 522 of row 520. By providing an optimal amount of energy to each zone, excessive drop ejecting element temperatures can avoided and wasted heat reduced, thereby resulting in reduced occurrences of print defects and a potential increase in the operating life of the drop ejecting elements. Additionally, because the operating frequency of printhead assembly 512 is inversely proportional to the temperature, a reduction in waste heat may also enable printhead assembly 512 to operate at higher frequencies and therefore increase image data throughput.

Figure 11:
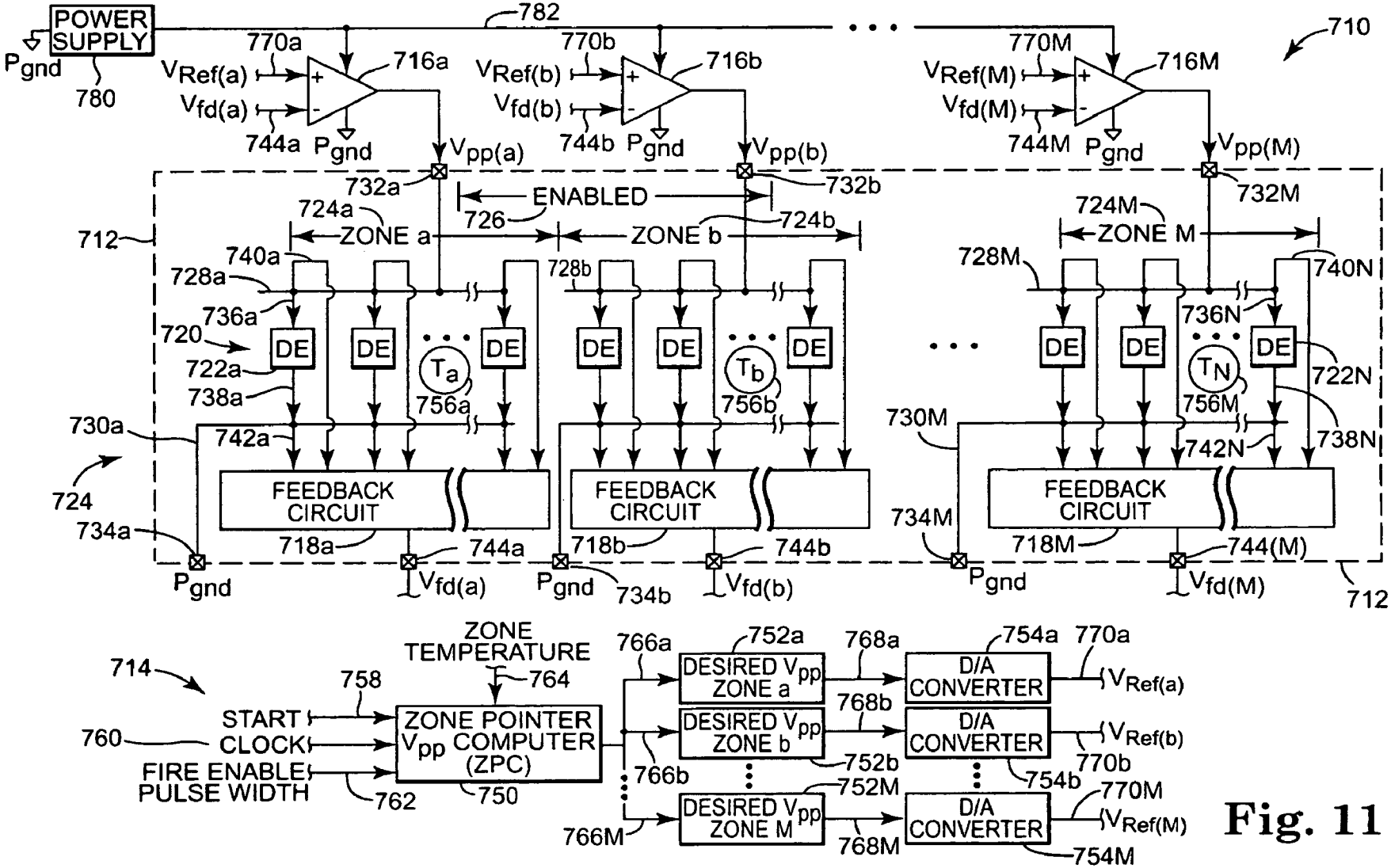
FIG. 11 is a block diagram illustrating a portion of one embodiment of an inkjet printing system employing zonal voltage control according to the present invention.

FIG. 11 is a block and schematic diagram illustrating a portion of a wide array inkjet printing system 710 according to the present invention employing zonal voltage control for controlling energy provided to drop ejecting elements. Printing system 710 includes a printhead assembly 712, a zone controller 714, and voltage regulators 716. Printhead assembly 712 further includes feedback circuits 718 and a row 720 of N drop ejecting elements 722*a* to 722N. In one embodiment, row 720 extends for a width substantially equal to a maximum dimension, e.g. a width of a print medium that can be inserted into a printer in which the printhead is located, or the maximum dimension for one part of the area of the fluid to be ejected. e.g. the maximum width of a print swath that can be printed on the print media. In one embodiment, as illustrated, feedback circuits 718 comprise a portion of the drive circuitry for printhead assembly 712. In one embodiment, as illustrated, voltage regulators 716 are external to printhead assembly 712. In one embodiment, voltage regulators 716 form a portion of controller 20 (see FIG. 1). Together, voltage regulators 716 and feedback circuits 718 form an energy controller 724 that, in conjunction with zone controller 714, controls energy provided to drop ejecting elements 722 through zonal voltage control of print head assembly 712.

Row 720 of N drop ejecting elements 722*a* to 722N is arranged into M drop ejecting zones, indicated as zones 724*a* to 724M, with each drop ejecting zone having at least one drop ejecting element 722. The number of drop ejecting elements 722 may vary from zone to zone, but the total number of drop ejecting elements of drop ejecting zones 724*a* to 724M sums to N. Each drop ejecting zone 724 has a corresponding $V_{pp}$ supply path 728, indicated as 728*a* to 728M, and a corresponding power ground path 730, indicated as 730*a* to 730M. Each zone's $V_{pp}$ supply path 728 receives a separate power supply voltage $V_{pp}$ at a corresponding $V_{pp}$ input pin 732, and each zone's power ground path is coupled to a corresponding ground pin 734. The drop ejecting element (s) 722 of each zone 724 are coupled between each zone's corresponding voltage supply path 728 and power ground path 730 via a corresponding power supply path 736 and a corresponding ground line 738, respectively.

In one embodiment, printhead assembly 712 is configured to print a row of N bits of image data in a print cycle, wherein each of the N bits of data corresponds to a different one of the N drop ejecting elements 722. In one embodiment, as described by FIG. 7 above, a group 726 of adjacent drop ejecting elements is enabled to conduct simultaneously with each conducting drop ejecting element 722 of group 726 conducting electrical current from its corresponding $V_{pp}$ supply path 728 to its corresponding ground path 730 so as to cause an ink droplet to be ejected from it. To print the row of data, group 726 of enabled drop ejecting elements is shifted from left-to-right across row 720 by sequentially enabling one additional drop ejecting element 722 at the right end and disabling one drop ejecting element 722 at the left end of group 726 after a time interval. In one embodiment, the time interval may correspond to each cycle of a system clock.

As illustrated, as group 726 is shifted from left-to-right across row 720, group 726 may comprise drop ejecting elements 722 from one or more of the drop ejecting zones 724. The number of enabled drop ejecting elements 722 within enabled group 726 that actually conduct, or fire, at a given time depends on the corresponding image data to be printed. Due to parasitic resistances of $V_{pp}$ supply paths 728 as described above by FIG. 7 and the number of firing drop ejecting elements 722, the voltage across each conducting drop ejecting element 722 in given drop ejecting zone 724 may vary.

Each drop ejecting zone 724 has a corresponding feedback circuit 718. In a fashion similar to that described above by FIG. 6 and FIG. 7, each feedback circuit 718 is configured to couple across each conducting drop ejecting element 722 of its corresponding drop ejecting zone 724 via paths 740 and 742. Each feedback circuit 718 provides a feedback voltage ($V_{fd}$) at an output pin 744 that is substantially equal to an average of the voltages across each conducting drop ejecting element 722 of its corresponding drop ejecting zone 724.

Zone controller 714 includes a zone pointer/$V_{pp}$ computer (ZPC) 750, zone registers 752, and digital-to-analog (D/A) converters 754, with each zone register 752 and each D/A converter 754 corresponding to a different one of the drop ejecting zones 724. Zone controller 714 further includes temperature sensors 756 located internally to printhead assembly 712, with each temperature sensor 756 being located proximate to and corresponding to a different one of the drop ejecting zones 724. In other embodiments, each drop ejecting zone 724 may have multiple corresponding temperature sensors 756. Each temperature sensor 756 provides temperature data representative of the temperature of the drop ejecting elements 722 of its corresponding drop ejecting zone 724.

ZPC 750 receives a print cycle start signal at 758, a clock signal at 760, and a fire enable pulse width signal at 762 from a controller, such as controller 20 (see FIG. 1), wherein the fire enable pulse width signal indicates the number of adjacent enabled drop ejecting elements comprising group 726. ZPC 750 also receives at 764 the temperature data from zone temperature sensors 756 located within printhead assembly 712. In one embodiment, as illustrated, zone controller 714, except for temperature sensors 756, is external to printhead assembly 712. In one embodiment, zone controller 714, except for temperature sensors 756, forms a portion of controller 20.

ZPC 750 determines a desired $V_{pp}$ supply voltage level for each drop ejecting zone 724, such that if the power supply voltage $V_{pp}$ provided to each zone's $V_{pp}$ supply path 728 is maintained at a value substantially equal to its corresponding desired $V_{pp}$ level, an optimal amount of energy (i.e., neither too little, nor too much) will be provided to the conducting drop ejecting elements 722 of each drop ejecting zone 724. In one embodiment, ZPC 750 calculates the desired $V_{pp}$ for each drop ejecting zone 724 based on the width of the enabled group 726 received at 762 and on the temperature data received at 764 from each zone's corresponding temperature sensor 756. In other embodiments, ZPC 750 further bases the desired $V_{pp}$ calculation for each zone based on the average resistance of the firing resistors of each drop ejecting zone 726 and on other factors that may affect the energy required by each zone's firing resistors.

ZPC 750 places the calculated desired $V_{pp}$ level for each drop ejecting zone 724 in a corresponding zone register 752 via a path 766. A corresponding D/A converter 754 is coupled to each of the zone registers 752 via a path 768. Each D/A converter receives via a path 768 the desired $V_{pp}$ value from its corresponding zone register 752 and converts it to an analog reference voltage value ($V_{Ref}$) at 770.

Voltage regulators 716 each comprise an operational amplifier configured to operate as an error amplifier, with each voltage regulator corresponding to a different one of the drop ejecting zones 724. Voltage regulators 716 are connected to a power supply 780 at a positive voltage terminal via a path 782 and to ground at a negative voltage terminal. Each voltage regulator 716 receives at an inverting terminal the feedback voltage $V_{fd}$ provided at output pin 744 by feedback circuit 718 corresponding to its drop ejecting zone 724. Additionally, each voltage regulator 716 receives at a non-inverting terminal the reference voltage $V_{Ref}$ provided at 770 by the D/A converter 754 corresponding to its drop ejecting zone 724.

Each voltage regulator 716 provides a power supply voltage $V_{pp}$ via input pin 732 to the voltage supply path 728 of its corresponding drop ejecting zone 724, wherein $V_{pp}$ is based on comparing $V_{Ref}$ to $V_{fd}$. When $V_{fd}$ is less than $V_{Ref}$, voltage regulator 716 raises $V_{pp}$ provided to $V_{pp}$ input pin 732. Conversely, When $V_{fd}$ exceeds $V_{Ref}$, voltage regulator 716 decreases $V_{pp}$ provided to $V_{pp}$ input pin 732. In this fashion, each voltage regulator 716 provides and maintains to the conducting drop ejecting elements in it's corresponding drop ejecting zone 724 a voltage across drop ejecting elements 722 that is substantially equal to $V_{Ref}$, and thus, substantially equal to the desired $V_{pp}$ for its corresponding drop ejecting zone calculated by ZPC 750.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection assembly comprising:

a plurality of drop ejecting elements arranged in a plurality of zones, with each zone having at least one drop ejecting element, wherein the drop ejecting elements of each zone are configured to conduct electrical current between a corresponding supply voltage and a corresponding reference voltage, and wherein up to all drop ejecting elements of a group of the plurality of drop ejecting elements are enabled to conduct at a given time, with each conducting drop ejecting element of the enabled group having a corresponding drop ejecting voltage;

a zone controller configured to provide a corresponding desired supply voltage for each zone based on a temperature level of the drop ejecting elements of the corresponding zone; and an energy controller configured to couple across each conducting drop ejecting element of the enabled group and configured to regulate the supply voltage for each zone based on selected corresponding drop ejecting voltages and on each zone's corresponding desired supply voltage, wherein the enabled group is successively shifted through each zone according to a selected enabling pattern in response to a start signal and a clock, wherein each of the drop ejecting elements of the plurality of drop ejecting elements is coupled between a shared supply path at the supply voltage and a shared return path at the reference voltage, and wherein each drop ejecting element is individually selectable to conduct electrical current from the shared supply path to the shared return path to cause the drop ejecting element to eject a fluid droplet, wherein the zone controller comprises:

a zone computer configured to calculate a setpoint supply voltage for each zone based on the temperature level of the drop ejecting elements of the corresponding zone and an enable signal representative of a number of drop ejecting elements in the enabled group;

a plurality of memories each corresponding to and storing the calculated setpoint supply voltage for a corresponding one of the zones; and a digital-to-analog converter configured to convert a setpoint supply voltage from a selected one of the memories to the corresponding desired supply voltage, wherein the zone computer selects the selected one of the memories based on the start signal, the clock, and the selected enabling pattern.

2. The fluid ejection assembly of claim 1, wherein the zone controller further comprises:

a plurality of temperature sensors, each temperature sensor corresponding to and located proximate to a different one of the zones and configured to provide the temperature level of the drop ejecting elements of the corresponding zone.

3. The fluid ejection assembly of claim 1, wherein the enabled group comprises selected drop ejecting elements which are selected in response to the clock.

4. The fluid ejection assembly of claim 1, wherein the energy controller comprises:

a feedback circuit configured to provide a feedback voltage substantially equal to an average of selected corresponding drop ejecting voltages; and a voltage regulator configured regulate the supply voltage, the voltage regulator configured to compare the feedback voltage to the corresponding desired supply voltage and to adjust the supply voltage based on the comparison.

5. A fluid ejection assembly comprising:

a plurality of drop ejecting elements arranged in a plurality of zones, with each zone having at least one drop ejecting element, wherein the drop ejecting elements of each zone are configured to conduct electrical current between a corresponding supply voltage and a corresponding reference voltage, and wherein up to all drop ejecting elements of a group of the plurality of drop ejecting elements are enabled to conduct at a given time, with each conducting drop ejecting element of the enabled group having a corresponding drop ejecting voltage;

a zone controller configured to provide a corresponding desired supply voltage for each zone based on a temperature level of the drop ejecting elements of the corresponding zone; and an energy controller configured to couple across each conducting drop ejecting element of the enabled group and configured to regulate the supply voltage for each zone based on selected corresponding drop ejecting voltages and on each zone's corresponding desired supply voltage, wherein the enabled group is successively shifted through each zone according to a selected enabling pattern in response to a start signal and a clock, wherein each zone includes a supply path at the corresponding supply voltage and a return path at the corresponding reference voltage with each drop ejecting element of a zone coupled between the zone's supply path and return path, and wherein each drop ejecting element of a zone is individually selectable to conduct electrical current from the supply path to the return path to cause the drop ejecting element to eject a fluid droplet, wherein the zone controller comprises:

a zone computer configured to calculate a corresponding setpoint supply voltage for each zone based on the temperature level of the drop ejecting elements of the corresponding zone and an enable signal representative of a number of drop ejecting elements in the enabled group;

a plurality of memories, each memory corresponding to and storing the calculated setpoint supply voltage for a corresponding one of the zones; and a plurality of digital-to-analog converters each corresponding to a different one of the memories and configured to convert the setpoint supply voltage stored therein to a corresponding desired supply voltage.

6. The fluid ejection assembly of claim 5, wherein the energy controller comprises:

a plurality of feedback circuits, each corresponding to a different one of the zones and configured to provide a feedback voltage substantially equal to an average of selected corresponding drop ejecting elements of the corresponding zone; and a plurality of voltage regulators, each corresponding to and configured to regulate the supply voltage of a corresponding different one of the zones, each voltage regulator configured to compare the feedback voltage to the desired supply voltage of the corresponding zone and to adjust the supply voltage of the corresponding zone based on the comparison.

7. The fluid ejection assembly of claim 5, wherein the plurality of drop ejecting elements is configured as a row and each zone comprises a non-overlapping plurality of consecutive drop ejecting elements.

8. The fluid ejection assembly of claim 7, wherein the row extends for a width of a page of print media.

9. The fluid ejection assembly of claim 5, wherein the plurality of drop ejecting elements and at least a portion of the zone controller are formed on a thin-film structure formed on a substrate.

10. The fluid ejection assembly of claim 9, wherein the substrate includes a non-conductive material.

11. The fluid ejection assembly of claim 10, wherein the non-conductive material includes one of an oxide formed on a metal, carbon composite material, a ceramic material, and glass.

12. The fluid ejection assembly of claim 5, wherein the reference voltage is a ground.

13. A method of operating a fluid ejection assembly having a plurality of drop ejecting elements, comprising:

arranging the plurality of drop ejecting elements into a plurality of zones with each zone having at least one drop ejecting element, wherein the drop ejecting elements of each zone are configured to conduct electrical current between a corresponding supply voltage and a corresponding reference voltage;

enabling a group of the plurality of drop ejecting elements to conduct electrical current for an ejection operation;

conducting an electrical current through up to all drop ejecting elements of the enabled group, each conducting drop ejecting element having a corresponding drop ejecting voltage;

providing a corresponding desired supply voltage for each zone based on a temperature level of the drop ejecting elements of the corresponding zone; and regulating the supply voltage for each zone based on selected corresponding drop ejecting voltages and each zone's corresponding desired supply voltage, wherein providing the corresponding desired supply voltage further comprises:

calculating a setpoint supply voltage for each zone based on the temperature level of the drop ejecting elements of the corresponding zone and on an enable signal representative of a number of drop ejecting elements in the enabled group of drop ejecting elements;

storing the calculated setpoint supply voltage for each zone in a corresponding one of a plurality of memories; and converting the setpoint supply voltage for each zone to the corresponding desired supply voltage.

14. The method of claim 13, further comprising:

determining a feedback voltage substantially equal to an average of selected corresponding drop ejecting voltages.

15. The method of claim 14, wherein regulating the supply voltage further comprises:

comparing the corresponding desired voltage of a zone to the feedback voltage; and adjusting the supply voltage based on the comparison of the corresponding desired voltage to the feedback voltage.

16. The method of claim 15, further comprising:

increasing the supply voltage when the desired supply voltage exceeds the feedback voltage; and decreasing the supply voltage when the feedback voltage exceeds the desired supply voltage.

17. The method of claim 13, further comprising:

enabling a different group of the plurality of drop ejecting elements for a subsequent ejection operation as compared to a previous ejection operation.

18. The method of claim 17, further comprising:

forming a different enabled group for the subsequent ejection operation by disabling a drop ejecting element of the enabled group for the previous ejection operation and enabling a drop ejecting element not included in the enabled group for the previous ejection operation.

* * * * *

UNITED STATES PATENT AND TRADEMARK OFFICE

CERTIFICATE OF CORRECTION

PATENT NO. : 7,604,312 B2
APPLICATION NO. : 11/706618
DATED : October 20, 2009
INVENTOR(S) : John Wade It is certified that error appears in the above-identified patent and that said Letters Patent is hereby corrected as shown below:

In column 19, line 25, in Claim 4, after "configured" insert -- to --.

Signed and Sealed this

Nineteenth Day of January, 2010

David J. Kappos

David J. Kappos
*Director of the United States Patent and Trademark Office*